US010222149B2

(12) United States Patent
Daley, Jr.

(10) Patent No.: US 10,222,149 B2
(45) Date of Patent: Mar. 5, 2019

(54) FIREARM UPPER RECEIVER POSITIONING MECHANISM

(71) Applicant: Sig Sauer, Inc., Newington, NH (US)

(72) Inventor: William C. Daley, Jr., Kingston, NH (US)

(73) Assignee: Sig Sauer, Inc., Newington, NH (US)

( * ) Notice: Subject to any disclaimer, the term of this patent is extended or adjusted under 35 U.S.C. 154(b) by 0 days.

(21) Appl. No.: 15/491,427

(22) Filed: Apr. 19, 2017

(65) Prior Publication Data

US 2017/0299292 A1 Oct. 19, 2017

Related U.S. Application Data

(60) Provisional application No. 62/324,714, filed on Apr. 19, 2016.

(51) Int. Cl.
*F41A 3/00* (2006.01)
*F41A 3/66* (2006.01)
*F41A 11/00* (2006.01)

(52) U.S. Cl.
CPC ..... *F41A 3/66* (2013.01); *F41A 11/00* (2013.01)

(58) Field of Classification Search
CPC .... F41A 3/66; F41A 3/72; F41A 17/38; F41A 11/00; F41A 19/31
USPC ..... 42/6, 75.03, 75.01, 75.02
See application file for complete search history.

(56) References Cited

U.S. PATENT DOCUMENTS 1,370,118 A * 3/1921 Johnson ..... F41A 21/484 24/2.5
1,430,661 A * 10/1922 Lewis ..... F41A 3/26 42/69.02
2,090,340 A * 8/1937 Browning ..... F41A 5/02 42/16
2,112,660 A * 3/1938 Hudson ..... F41A 3/46 89/14.3
2,173,576 A * 9/1939 Brewer ..... F41A 3/12 42/16
2,223,092 A * 11/1940 Brewer ..... F41A 3/12 42/16
2,237,601 A * 4/1941 Holek ..... F41A 3/22 42/16
2,330,737 A * 9/1943 Pedersen ..... F41A 3/26 42/16
2,364,549 A * 12/1944 Pedersen ..... F41A 19/11 42/75.01
2,425,412 A * 8/1947 Barnes ..... F41A 9/19 42/69.02

(Continued)

OTHER PUBLICATIONS

Sweeney, Patrick, "POF-USA ReVolt Review," RifleShooter, Jul. 9, 2015, http://www.rifleshootermag.com/reviews, 8 pages.

(Continued)

*Primary Examiner* — Michael D David
(74) *Attorney, Agent, or Firm* — Finch & Maloney PLLC

(57) ABSTRACT

A firearm having a lower receiver including a takedown pin through hole and an upper receiver configured to receive the lower receiver. The upper receiver including a rear lug and the rear lug including a bore and a screw disposed in the bore. A takedown pin having a cam surface such that the upper receiver is drawn to the lower receiver as the takedown pin is inserted in the takedown pin through hole and the bore of the rear lug.

18 Claims, 18 Drawing Sheets

(56) References Cited

U.S. PATENT DOCUMENTS 2,447,091 A * 8/1948 Pope ..... F41A 11/00 42/18
2,466,902 A * 4/1949 Lochhead ..... F41A 3/32 89/182
2,594,861 A * 4/1952 Browning ..... F41A 5/02 42/75.03
2,679,123 A * 5/1954 Williams ..... F41A 11/00 42/75.02
2,685,754 A * 8/1954 Crittendon ..... F41A 3/26 42/16
3,150,458 A * 9/1964 Browning ..... F41A 21/484 42/75.02
3,584,533 A * 6/1971 Allyn ..... F41A 3/54 42/25
3,711,983 A * 1/1973 Allyn ..... F41A 3/54 42/75.03
4,109,403 A * 8/1978 Badali ..... F41A 21/484 42/75.02
4,416,186 A * 11/1983 Sullivan ..... F41A 3/26 89/198
4,475,437 A * 10/1984 Sullivan ..... F41A 3/72 42/70.06
4,502,367 A * 3/1985 Sullivan ..... F41A 3/72 89/181
4,505,182 A * 3/1985 Sullivan ..... F41A 3/72 42/69.02
4,964,232 A * 10/1990 Mainland ..... F41A 3/58 42/44
6,526,683 B1 * 3/2003 Crandall ..... F41A 19/09 42/40
7,444,775 B1 * 11/2008 Schuetz ..... F41A 9/71 42/49.02
9,194,638 B2 * 11/2015 Larson, Jr. ..... F41A 17/38
2009/0277067 A1 * 11/2009 Gregg ..... F41A 3/66 42/69.01
2009/0288324 A1 * 11/2009 Peterson ..... F41A 11/02 42/75.03
2013/0227869 A1 * 9/2013 Thordsen ..... F41C 27/00 42/6
2015/0330733 A1 11/2015 DeSomma et al.
2017/0160037 A1 * 6/2017 Gray ..... F41A 21/482
2017/0227312 A1 * 8/2017 Christensen ..... F41A 9/65

OTHER PUBLICATIONS

JP Tension Pin, JP Enterprises, retrieved Jul. 25, 2017, http://www.jprifles.com/1.5.1.7_small_tp.php, 1 page.

Z-M Weapons—AR-15/M16 Accu-Wedge, Brownells, http://www.brownells.com/rifle-parts/receiver-parts/receiver-hardware/accu-wedges/accu-wedge-sku993150100-16662-37718.aspx?sku=993150100, 2 pages.

KNS Precision, Inc.—AR-15/M16 Enhanced Takedown Pins, Brownells, http://www.brownells.com/rifle-parts/receiver-parts/receiver-hardware/receiver-pins/ar-15-m16-enhanced-takedown-pins-prod67218.aspx, 2 pages.

Bushmaster Firearms, 2012 Product Catalog, Firearms|Receivers|Barrels|Parts|Retail Accessories, Copyright 2012 Bushmaster Firearms International, Bushmaster.com, 86 pages.

Quinn, Jeff, "Demon Tactical Products Accessories for the AR-15/M-16/M-4 Rifle", Gunblast.com,Jul. 13, 2010, http://www.gunblast.com/Demon.htm, 3 pages.

AR15AccuShim, "Tightens Receivers Rock Solid Improves Handling, Helps Accuracy, Slows Wear", retrieved Jul. 25, 2017, http://www.wheeldiamond.com/ar15accushim.htm, 3 pages.

* cited by examiner

FIREARM UPPER RECEIVER POSITIONING MECHANISM

CROSS-REFERENCE TO RELATED APPLICATIONS

This application claims the benefit of U.S. Provisional Patent Application No. 62/324,714, filed on Apr. 19, 2016, which is herein incorporated by reference in its entirety.

FIELD OF DISCLOSURE

The present disclosure relates generally to firearms, and more particularly, to an automatic rifle with an upper receiver positioning mechanism.

BACKGROUND

Automatic or semi-automatic rifles typically include an upper receiver and a lower receiver. The upper receiver can support a number of rifle components, for example, a barrel and sights. The lower receiver may also support and/or house other components, such as an ammunition magazine, a grip, and a trigger mechanism. The upper receiver may be pivotally attached to the lower receiver using a pivot pin. A user of the firearm may access internal rifle components by pivoting the upper receiver away from the lower receiver about the pivot pin. Access to internal rifle components may be desirable for a number of reasons, such as cleaning and maintenance. The upper receiver is typically secured to the lower receiver using a takedown pin. The takedown pin may be located opposite of the pivot pin and proximate to the aft end of the receivers. When installed, the takedown pin secures the upper receiver to the lower receiver enabling operation of the rifle.

SUMMARY

One example embodiment provides a firearm including: a lower receiver including a takedown pin through hole; an upper receiver configured to receive the lower receiver and including a rear lug, the rear lug including a bore and a screw disposed in the bore; and a takedown pin including a cam surface, wherein the upper receiver is drawn to the lower receiver as the takedown pin is inserted in the takedown pin through hole and the bore of the rear lug. In some cases, the firearm includes a threaded insert installed in a wall of the rear lug, wherein the screw is inserted into the threaded insert and a distal end of the screw extends into in the bore of the rear lug. In some such cases, the screw is installed perpendicular to a longitudinal axis of the firearm. In some cases, the screw is installed perpendicular to a transverse axis of the firearm. In other such cases, the screw is installed through a bottom surface of the rear lug. In some other such cases, the screw can be adjusted to extend or contract an effective diameter of the bore. In other cases, the cam surface includes an upwardly sloped surface configured to receive a distal end of the screw disposed in the bore of the rear lug of the upper receiver and to draw the upper receiver to the lower receiver to reduce a gap there between as the takedown pin is inserted In some such cases, the takedown pin a downwardly sloped surface, the downwardly sloped surface progressing in a direction from an insertable end to a head of the takedown pin such that, when the takedown pin is inserted the screw contacts the downwardly sloped surface to provide a lateral force that biases the upper receiver against the lower receiver to reduce horizontal movement of the upper receiver in relation to the lower receiver along a transverse axis of the firearm. In some instances, the screw is a dog-point set screw. In other instances, the upper receiver and lower receiver define a gap there between when the takedown pin is fully inserted, wherein a size of the gap is shortened or lengthened by adjusting a position of a distal end of the screw within the bore of the rear lug. In other cases, at least a portion of the cam surface is sloped downwardly progressing in a direction from the insertable end to the head. In some other cases, wherein the takedown pin includes a substantially planar first surface, a second surface and a third surface, wherein: the first surface is located at a distance from a centerline of the takedown pin, the distance being less than a largest radius of a body of the takedown pin; the second surface is a tapered contoured surface adjacent the first substantially planar surface, the second surface tapered upwardly as it extends from the first substantially planar surface towards a head of the takedown pin; and the third surface having a first end and a second end, the first end transitioning from the second surface toward the head of the takedown pin, wherein at least a portion of the third surface is sloped downwardly from the first end to the second end. In other instances, when the takedown pin is installed, the cam surface is to face downward towards the lower receiver. In some other instances, the cam surface is positioned about 90 degrees around the takedown pin from to a longitudinal groove in the takedown pin, the longitudinal groove constructed and arranged for receiving a detent plunger. In some such cases, the longitudinal groove includes a depression in each end of the groove, each depression positioned and sized to receive the detent plunger in an extended position. In yet other cases, the cam surface is formed in a floor of a longitudinal groove for receiving a detent plunger. In some such cases, the longitudinal groove includes a depression in each end of the groove, each depression positioned and sized to receive the detent plunger in an extended position. In some cases, the upper receiver further comprises: a forward lug disposed on the upper receiver, wherein the forward lug includes a bore and an adjustable bushing disposed in the bore; and a pivot pin installed in the lower receiver and the bushing, wherein the upper receiver is pivotally attached to the lower receiver. In other instances, the rear lug further includes a threaded hole located within a bottom surface of the rear lug and perpendicular to the bore of the rear lug. In some such instances, the firearm includes a lock nut disposed on the screw, wherein the lock nut is to be tightened against the rear lug to secure the screw within the threaded hole of the rear lug. In some other such instances, the lock nut is a jam nut. In other cases, the firearm includes a self-locking element disposed on one or more threads of the screw, wherein the self-locking element is to engage one or more threads of a threaded hole of the rear lug to secure the screw in the threaded hole of the rear lug. In some such cases, the self-locking element is a nylon patch.

According to another example embodiment, a firearm includes a lower receiver including two mounting brackets, each mounting bracket defining a through hole and having an interior and an exterior surface; an upper receiver configured to receive the lower receiver and including a forward lug, the forward lug including a bore and an adjustable bushing disposed in the bore; and a pivot pin installed in the forward lug and the two mounting brackets, wherein the upper receiver is pivotally attached to the lower receiver. In some cases, the bushing can be horizontally adjusted in the bore of the forward lug, such that, when the pivot pin is installed, the interior surface of each mounting bracket is in contact with either the adjustable bushing or the forward lug and prevents side-to-side movement of the upper receiver in relation to the lower receiver. In other cases, the adjustable bushing includes a head, such that, the head provides a bearing surface to distribute an applied force transmitted from the upper receiver to the lower receiver. In some such cases, the head of the adjustable bushing includes one or more cut outs for receiving a tool. In other cases, the upper receiver further comprises: a rear lug disposed on the upper receiver, wherein the rear lug includes a bore and a screw disposed in the bore; and a takedown pin having a cam surface, wherein the takedown pin is installed in the lower receiver and the bore of the rear lug, such that, the cam surface contacts the screw causing the upper receiver to make contact with the lower receiver.

According to another example embodiment, a firearm includes a lower receiver including a takedown pin through hole; an upper receiver configured to receive the lower receiver and including a rear lug and a forward lug, wherein: the rear lug includes a bore, a threaded portion passing through the rear lug into the bore, and a screw, wherein the screw is installed in the threaded portion and disposed in the bore; and the forward lug including a bore and a bushing, wherein the bushing is installed in the bore; a takedown pin having a cam surface, wherein the upper receiver is drawn to the lower receiver as the takedown pin is inserted into the takedown pin through hole and the bore of the rear lug; and a pivot pin installed in the lower receiver and the bushing, wherein the upper receiver is pivotally attached to the lower receiver.

BRIEF DESCRIPTION OF THE DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

General Overview

Figure 1:
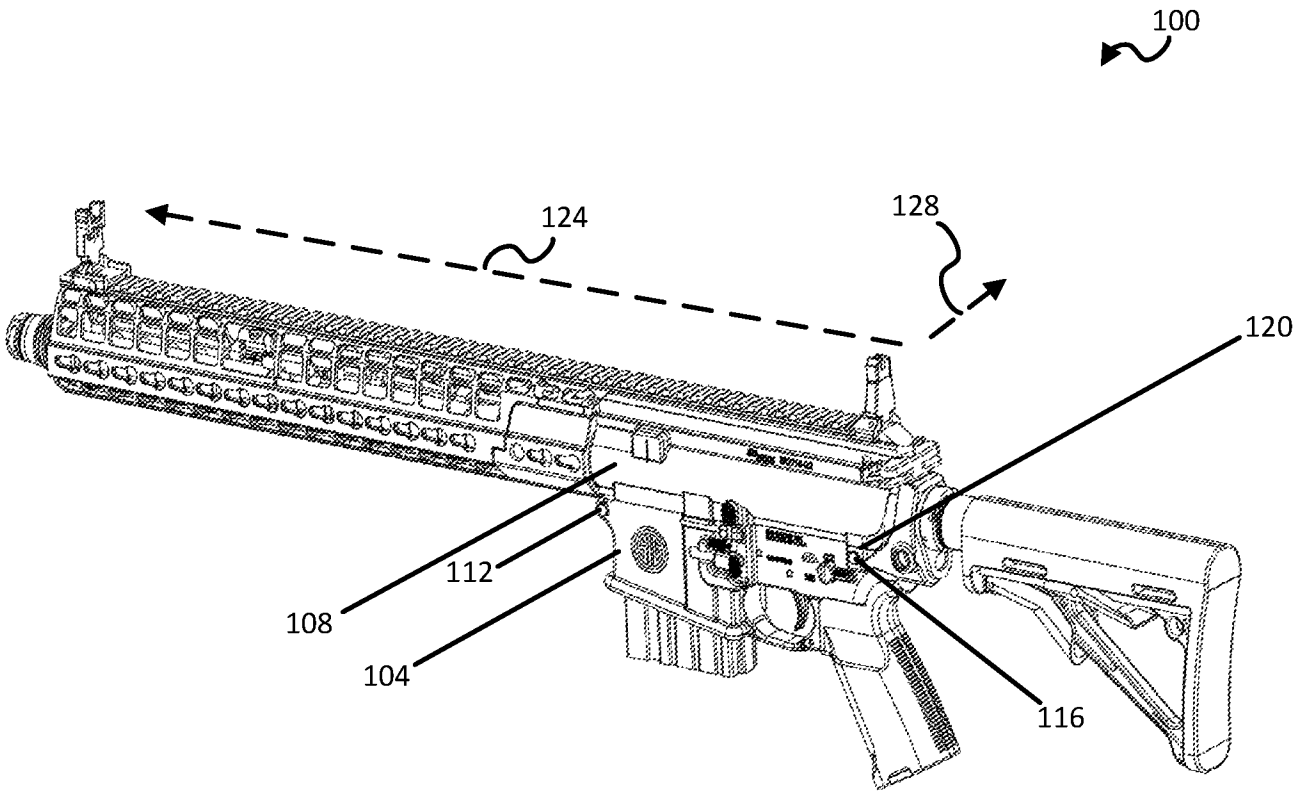
FIG. 1 is a perspective view of an automatic rifle having upper and lower receivers attached using a pivot pin and a takedown pin, in accordance with an embodiment of the present disclosure.

As previously discussed, automatic rifles may include an upper and lower receiver that are attached and secured together using a pivot pin and takedown pin. Dimensional tolerances of rifle components, however, affect how automatic rifles are constructed and assembled. For efficiency and ease of assembly, component tolerances may be larger than ideal, resulting in both vertical and horizontal play between the upper and lower receivers when the rifle is fully assembled. This movement may occur about the pivot pin, takedown pin or both during rifle firing. Movement about the pivot pin, for example, may occur along a transverse axis of the rifle in a horizontal direction. The upper receiver may move horizontally in relation to the lower receiver because a forward lug of the upper receiver may not fully fill the space between the brackets on the lower receiver when the pivot pin is installed. As a result, a gap may exist between these components. This gap may allow the upper receiver to move in a horizontal direction in relation to the lower receiver. This movement may be, for example, approximately 0.010 to 0.020 inches.

Movement about the takedown pin may occur in the horizontal and vertical directions. The upper receiver may move horizontally because, due to necessary manufacturing tolerances, a rear lug of the upper receiver may not contact both adjoining interior surfaces of the lower receiver when the takedown pin is installed. As a result, the upper receiver may move horizontally in relation to the lower receiver by a distance approximately equal to the gap between the rear lug and the interior surfaces of the mounting brackets in the lower receiver. When fully assembled, the upper receiver may also move vertically in relation to the lower receiver because the mating surfaces of the upper and lower receivers may not be biased against one another. This may be the result of a takedown pin that has an outer diameter that is smaller than the inner diameter of the bore through the rear lug, the bore through the bracket, or both. As a result, there is some play around the takedown pin when it is installed resulting in a gap along the longitudinal interface between the upper and lower receivers. This gap may permit the upper receiver to move vertically up and down in relation to the lower receiver during rifle firing. This gap may be, for example, approximately 0.010 to 0.020 inches. Thus, more than one gap may be present due to the necessary tolerances in the upper and lower receivers as well as the pivot pin and takedown pin. No matter which gap is present, any play between the upper receiver and lower receiver may diminish the accuracy of the rifle because the barrel and projectile may move in conjunction with the upper receiver in response to recoil forces generated during rifle firing. As the manufacturing tolerances cannot be reduced for mass produced firearms without a greatly increased scrap rate, the resulting gaps are necessary and common, and these gaps and resulting movement have become expected by firearm users.

In accordance with a set of embodiments, an upper receiver positioning mechanism for an automatic rifle is disclosed. In some embodiments, the upper receiver positioning mechanism can adjust the upper receiver to reduce or otherwise eliminate vertical, horizontal, and/or rolling motion of the upper receiver about the takedown pin. In other embodiments, the upper receiver positioning mechanism can adjust the forward end of the upper receiver to reduce or eliminate any side-to-side movement of the upper receiver about the pivot pin. In yet further embodiments, the upper receiver positioning mechanism may constrain the movement of the upper receiver about both the pivot pin and takedown pin.

According to an embodiment, the upper receiver positioning mechanism may include a takedown pin positioning mechanism. The takedown pin positioning mechanism may comprise a lug including a bore therethrough, a screw adjustable in the bore, and a takedown pin. The lug may be in the upper or lower receiver. In an example case, the adjustable screw may be installed in a rear lug of the upper receiver. In this case, the screw may be inserted into a bottom surface of the rear lug, such that, an end of the screw can be advanced into the bore of the rear lug. The lug may include a threaded insert for receiving the screw. In other embodiments, the lug itself may be threaded to receive the screw. The screw can be positioned so that it protrudes into the bore of the lug to interface with a cam surface of the takedown pin when the takedown pin is inserted through the bore. Advancement of the end of the screw into the bore can reduce the effective diameter of the bore. In this embodiment, the takedown pin may include three surfaces: (1) an installation surface, (2) a cam surface and (3) an adjustment surface. The installation surface may reduce the effective diameter of the takedown pin to enable quick and efficient insertion of the takedown pin by providing ample clearance and less lateral resistance between the leading portion of the pin and the screw. As the takedown pin is pushed further through the lug bore, the screw may contact the cam surface. In this case, the cam surface may be tapered to guide the screw along the pin to prevent binding or damage to the screw, pin or combination thereof. The cam surface can interface with the screw and the resulting cam action provides a vertical force causing the upper receiver to move vertically. In some embodiments, this vertical movement of the upper receiver is downward, pulling the upper receiver into the lower receiver. When the takedown pin is fully installed, the screw may contact the adjustment surface. The adjustment surface may provide a bearing surface for the screw to maintain the upper receiver in the adjusted position. In some instances, the adjustment surface may be sloped with respect to the axis of the takedown pin so that the upper receiver is biased against an interior surface of the lower receiver in a horizontal direction.

In an exemplary embodiment, the positioning of the upper receiver may be adjusted to eliminate movement of the upper receiver in relation to lower receiver (as previously described) by installing the takedown pin having a cam surface. As the takedown pin passes through the lower receiver and into the bore of the rear lug of the upper receiver, the screw may contact the one or more of the cam surfaces. With the screw properly adjusted and the takedown pin fully installed, the downward force applied to the exposed end of the screw from contact with the cam surface causes the screw and the rear lug to be displaced downward until the upper receiver contacts the lower receiver.

In one set of embodiments, the upper receiver positioning mechanism may include a pivot pin positioning mechanism. The pivot pin positioning mechanism can include an adjustable bushing. In this example case, the bushing can be externally threaded for installation into a threaded bore of a forward lug of the upper receiver. The bushing may include a head that provides a bearing surface for transferring the applied load from the upper receiver to the lower receiver when the bushing bridges a gap between the two receivers.

In this embodiment, the gap between the forward lug of the upper receiver and the walls of the lower receiver may be reduced or eliminated using the bushing. In this case, the bushing may be installed into the bore of the forward lug, such that, when the pivot pin is installed into the upper and lower receivers, the bushing may contact the lower receiver. With the bushing bridging or filling the horizontal gap between the two receivers, the upper receiver can be prevented from moving in the horizontal direction.

As will be appreciated in light of this disclosure, some embodiments may realize benefits and advantages as compared to existing approaches. For instance, the embodiments described herein may improve the accuracy of the rifle, because the relative motion between the upper receiver and the lower receiver is reduced or eliminated. The reduction of the gap between the upper and lower receivers can also provide a more solid feel to the firearm. The increased level of contact between the upper and lower receivers can prevent any motion of the upper receiver caused by recoil forces generated during rifle firing, and thus improve overall rifle accuracy. In other instances, the embodiments described herein may allow manufacturers of automatic rifles to produce rifles more efficiently and easily without the use of additional or special tooling while maintaining rifle accuracy. Manufacturers, for example, can mass produce rifles as currently done in the industry and then install the mechanisms described herein, to fine tune the installation of rifle components. With significant variation in sizes and tolerances of rifle components, these mechanisms may enable a rifle manufacturer to quickly and easily adjust the rifle assembly without undue delay. The embodiments described herein can also be implemented subsequently during the service life of the rifle. The takedown pin mechanism, for example, can enable users to subsequently adjust the position of the upper receiver during the life of the rifle to compensate for wear of components over time. In this instance, a user may simply tighten or loosen the screw to re-position the upper receiver. Similar adjustments may be accomplished at the forward pivot pin mechanism to reduce or eliminate relative motion between the upper receiver and the lower receiver in the horizontal direction. In this case, the bushing may either be threaded into or out of the forward lug, as needed, to allow for pivoting while maintaining contact between the bushing and the brackets of the lower receiver.

Rifle Structure

Figure 2:
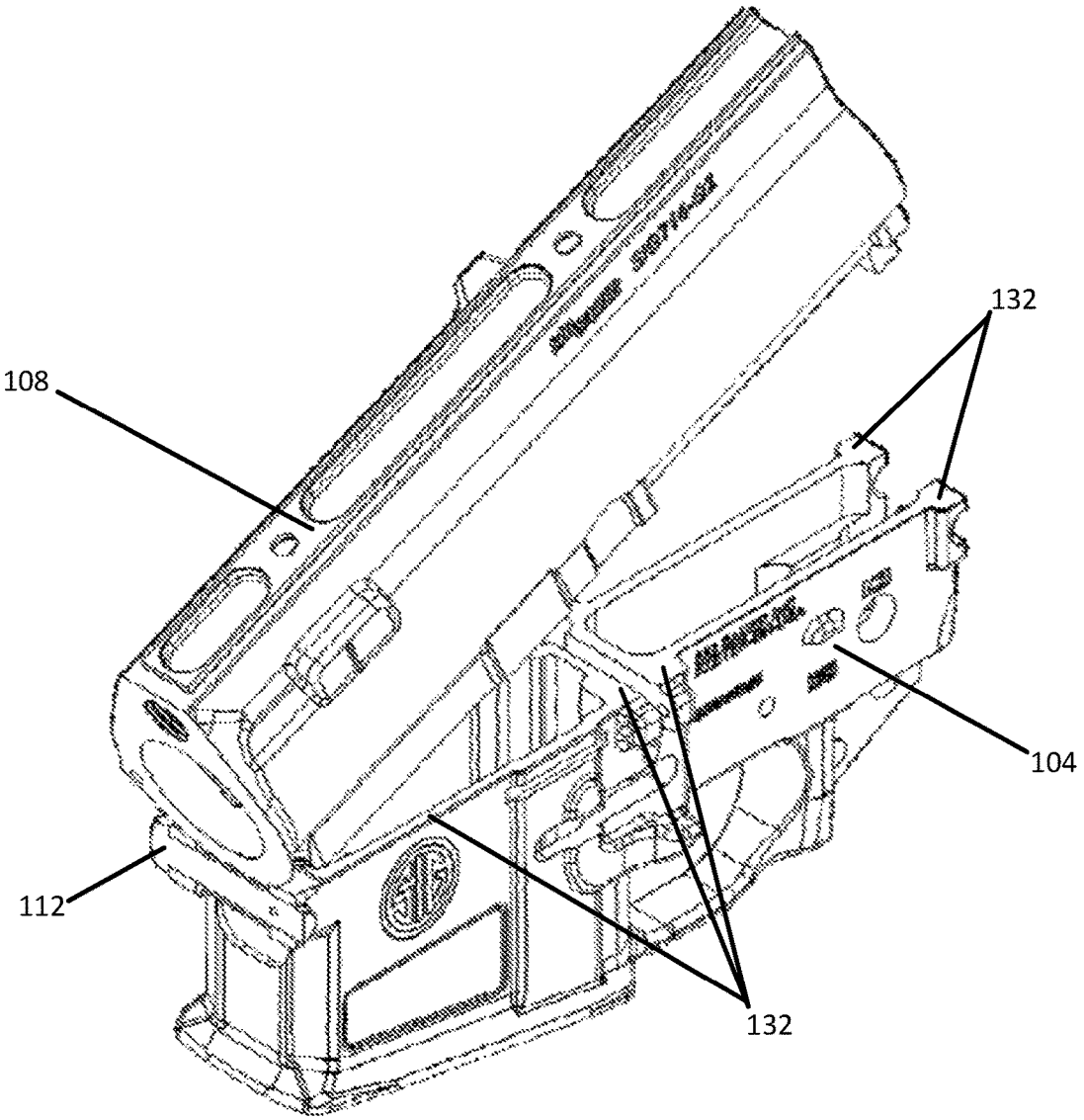
FIG. 2 is a perspective cut-away view of the automatic rifle with an upper receiver rotated about a pivot pin, in accordance with an embodiment of the present disclosure.

FIG. 1 is a perspective view of one embodiment of an automatic rifle 100 having a lower receiver 104 and an upper receiver 108. FIG. 2 is a perspective cut-away view of the automatic rifle 100 with an upper receiver 108 rotated about a pivot pin 112, in accordance with an embodiment of the present disclosure. The lower receiver 104 may be positioned beneath and support the upper receiver 108. The lower receiver 104 may include other rifle components, for example, a grip or trigger mechanism. Other components of the rifle 100, such as a barrel and sights, can be supported or housed by the upper receiver 108. The upper receiver 108 may be pivotally attached to a lower receiver 104 using a pivot pin 112. The pivot pin 112 pivotally connects the forward ends of upper receiver 108 and lower receiver 104. As can be seen in FIG. 2, when rotated or pivoted about the pivot pin 112, the upper receiver 108 can be separated from the lower receiver 104 to facilitate cleaning and maintenance of the rifle 100 without completely separating the two receivers from one another. To fix or secure the upper receiver 108 to the lower receiver 104, a takedown pin 116 may be installed. The takedown pin 116 maintains the position of the upper receiver 108 in relation to the lower receiver 104 when the pin 116 is installed into the aft end of the receivers. With the takedown pin 116 installed, the upper receiver 108 and the lower receiver 104 may define a gap 120 (as shown) along mating surfaces 132 of the lower receiver 104. The gap 120 may be caused by component tolerances that are necessary for manufacturing the rifle 100 or through the wear of individual rifle components over time.

Figure 3:
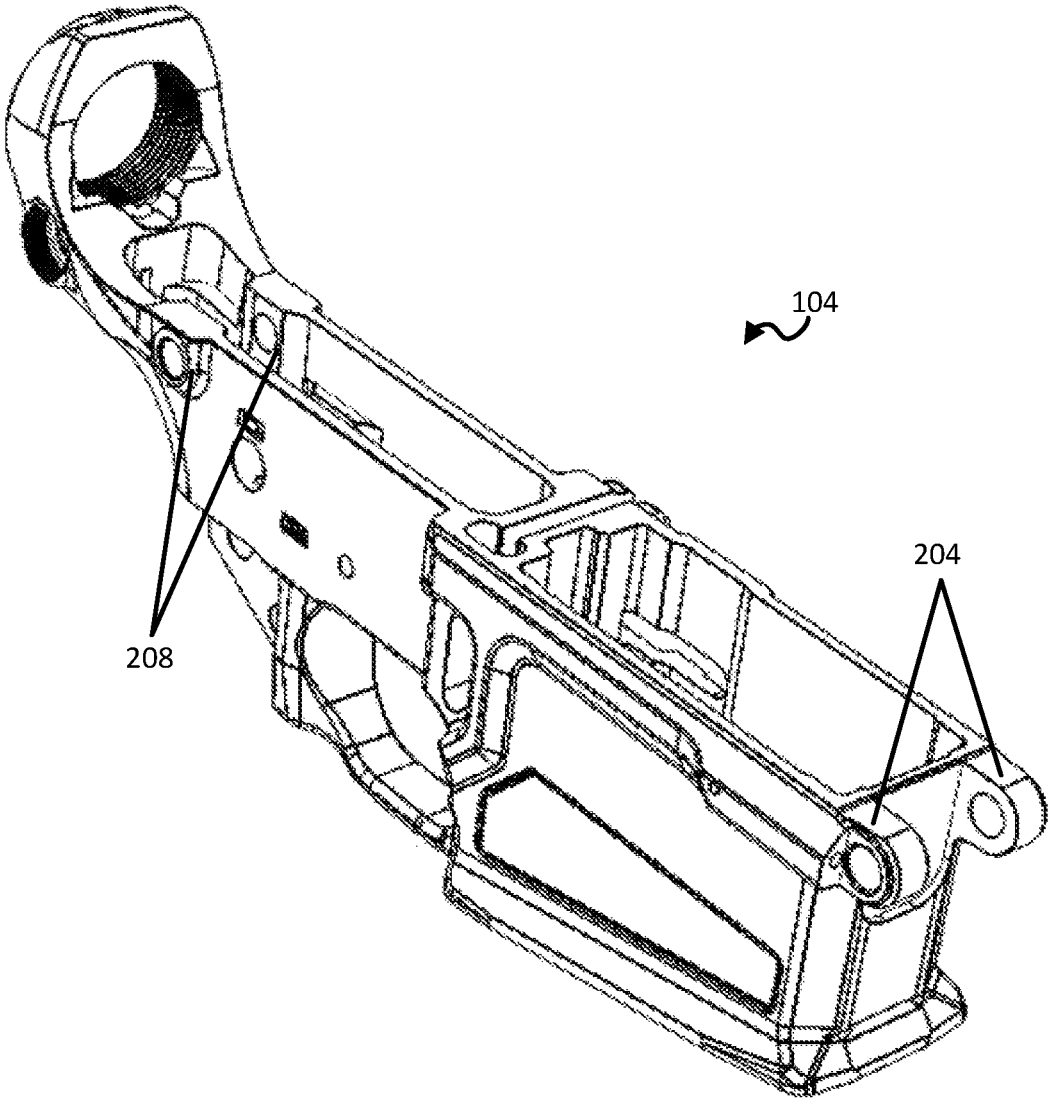
FIG. 3 is a perspective view of a lower receiver, in accordance with an embodiment of the present disclosure.

FIG. 3 is a perspective view of an embodiment of a lower receiver 104 illustrating forward mounting brackets 204 and aft mounting brackets 208. The forward mounting brackets 204 receive and support the pivot pin 112. In general, the forward mounting brackets 204 may have any shape and/or be located at any position suitable for receiving the pivot pin 112 and the upper receiver 108. In an example case, the forward mounting brackets 204 can be positioned at the forward end of the lower receiver 104 and may extend from a forward surface of the lower receiver 104 in a direction along the longitudinal axis 124 (FIG. 1). The forward mounting brackets 204 may also be parallel with one another along the transverse axis 128 (FIG. 1). The forward mounting brackets 204 can also include a bore for receiving the pivot pin 112. While the forward mounting brackets 204 may support the pivot pin 112, the aft mounting brackets 208 can support the takedown pin 116. To this end, the aft mounting brackets 208 may be any size or shape suitable for receiving the takedown pin 116 and the upper receiver 108. In this case, the aft mounting brackets 208 can be integrated into the aft end of the lower receiver 104 and include a bore for receiving the takedown pin 116. To pivotally attach the upper receiver 108 to the lower receiver 104, the upper receiver 108 can be configured to receive the pivot pin 112 and takedown pin 116.

Figure 4:
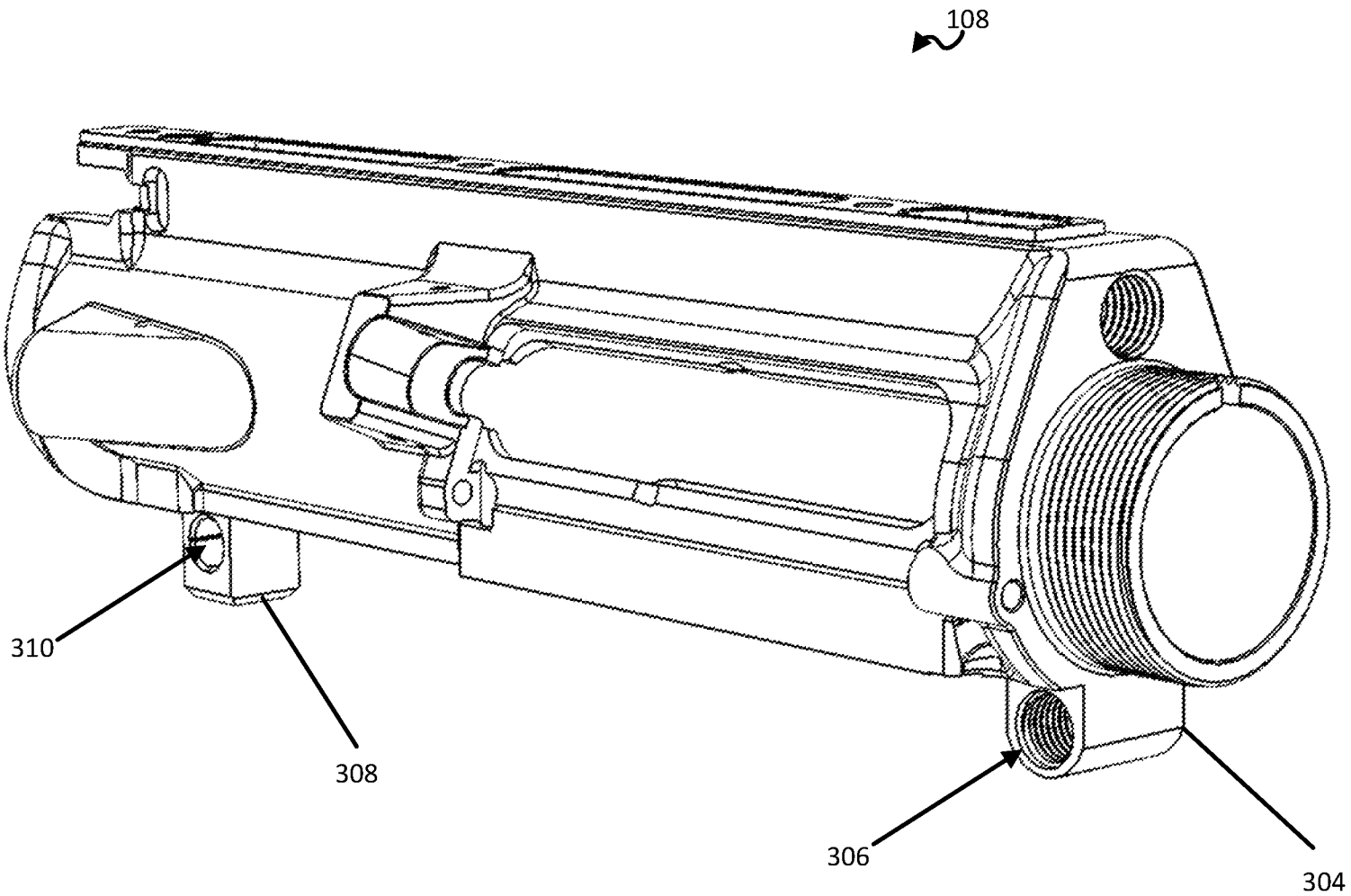
FIG. 4 is a perspective view of an upper receiver, in accordance with an embodiment of the present disclosure.

FIG. 4 is a perspective view of an embodiment of an upper receiver including a forward lug 304 and a rear lug 308. The upper receiver 108 may be configured such that the forward lug 304 and rear lug 308 are received by forward mounting brackets 204 and aft mounting brackets 208 (respectively). The forward lug 304 may connect the upper receiver 108 to the lower receiver via pivot pin 112 to enable the upper receiver 108 to pivot or rotate about the pivot pin 112. In an example case, the forward lug 304 may be located at the forward end of the upper receiver 108 and may extend downward from a bottom surface of upper receiver 108. The forward lug 304 may include a bore 306 in the direction of the transverse axis 128 to receive the pivot pin 112. The bore 306 may be threaded for receiving a bushing, as will be described further herein. While the forward lug 304 may receive the pivot pin 112, the rear lug 308 can receive the takedown pin 116. The rear lug 308 may connect the upper receiver 108 to the takedown pin 116 to secure or otherwise fix the upper receiver 108 to the lower receiver 104. In this example case, the rear lug 308 can be located proximate to the aft end of the upper receiver 108 and may extend downward from the bottom surface of the upper receiver 108. The rear lug 308 may include a bore 310 having an axis in the direction of the transverse axis 128 to receive the takedown pin 116 to facilitate assembly of rifle 100.

For ease of rifle assembly, the components of the rifle 100 may be manufactured with machining tolerances that enable efficient rifle assembly without an excessive scrap rate and without the use of additional or special tooling. As previously described, these tolerances may allow the upper receiver 108 to be displaced vertically in relation to the lower receiver or move horizontally in relation to the lower receiver or both during firing of rifle 100. As a result, the movement of the upper receiver 108 may cause inaccuracies during rifle firing. To limit or otherwise eliminate movement of the upper receiver 108 and thus improve the accuracy of the rifle 100, the devices and mechanisms disclosed herein can securely and tightly attach the upper receiver 108 to the lower receiver 104.

Takedown Pin Positioning Mechanism Structure and Operation

As previously described, during firing of automatic rifle 100 the upper receiver 108 may be displaced in relation to the lower receiver 104 due to recoil forces. This displacement may result in the upper receiver 108 moving in a vertical and/or horizontal direction in relation to the lower receiver 104. To reduce or eliminate this movement, a takedown pin positioning mechanism is provided that draws down the upper receiver 108 onto the lower receiver 104 and thus reduces or eliminates the gap 120 defined by the receivers. With the gap 120 eliminated, the upper receiver 108 can maintain its position in relation to the lower receiver 104 and movement between the two receivers is reduced or eliminated. In some embodiments, the gap 120 may be eliminated so that the upper and lower receivers are in frictional contact with one another at portions of, or the entire region of, the previous position of the gap. In other embodiments, the gap 120 is reduced so that the freedom of movement between the upper and lower receivers is reduced. For instance, the positioning mechanism can reduce the gap 120 by 50%, 75% or greater than 90% at one or more points along the interface between the receivers. Similarly, when compared to the same rifle without the positioning mechanism, the gap 120 may be decreased by approximately 0.010 to 0.020 inches.

Figure 5:
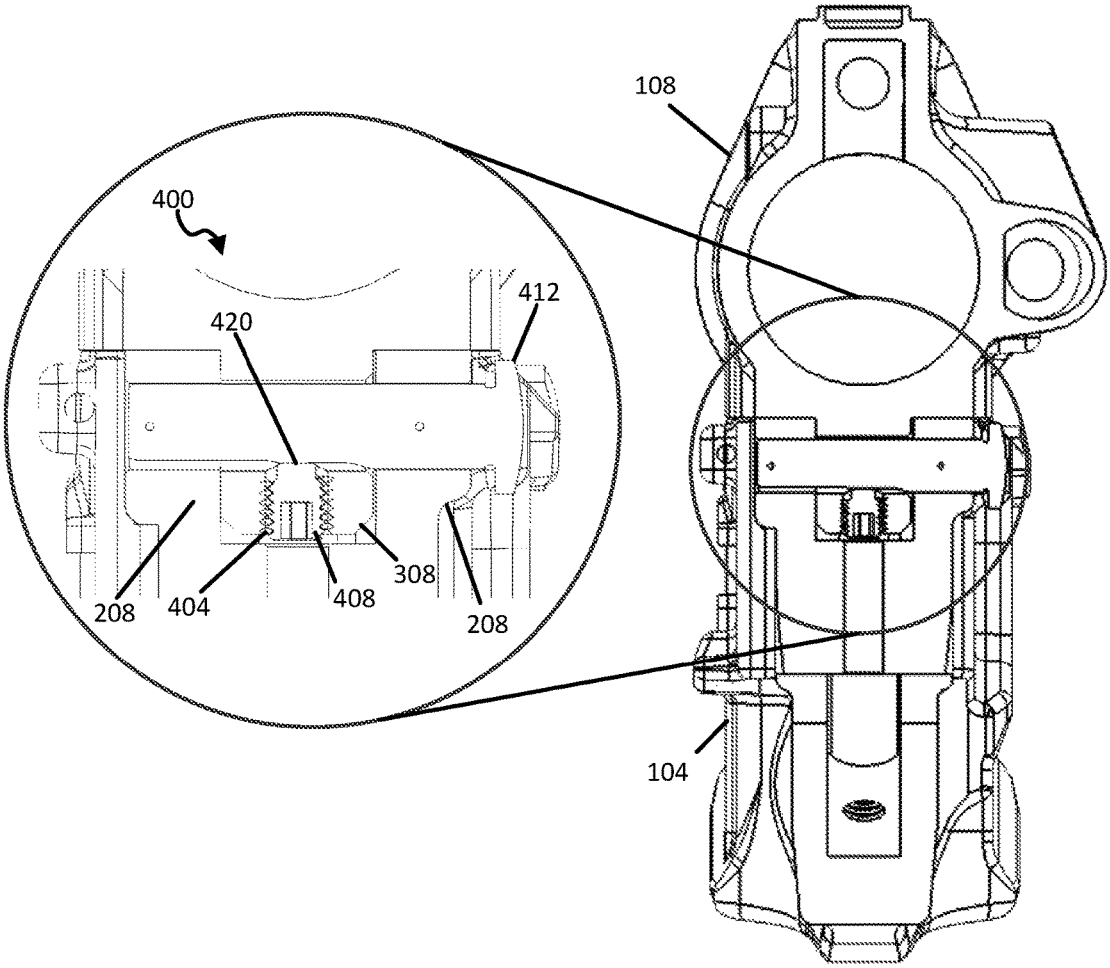
FIG. 5 is a cross-sectional view of an automatic rifle illustrating a takedown pin positioning mechanism, in accordance with an embodiment of the present disclosure.

FIG. 5 is a cross-sectional view of automatic rifle 100 illustrating a takedown pin positioning mechanism 400, in accordance with an example embodiment. The positioning mechanism 400 may include a threaded insert 404, screw 408, and takedown pin 412. As can be seen, the rear lug 308 of the upper receiver 108 includes a hole for receiving the threaded insert 404. This hole may be located perpendicular to the bore 310 for receiving the takedown pin 412 and may be located anywhere in the bottom surface of the rear lug 308, such that, the threaded insert 404 may be installed.

When installed in the rear lug 308, the threaded insert 404 can provide a threaded hole for receiving a fastener (e.g., screw 408 as will be described). The threaded insert 404 may include external and internal threads for engaging the rear lug 308 and the fastener (respectively). Accordingly, the rear lug 308 itself may be internally threaded to receive the insert 404 or, in some cases, receive the screw 408 (as described below). The threaded insert 404 can be any type of insert, such as a helical insert or screw-thread insert, and may be comprised of, for example, steel. An example of a helical insert is a HELI-COIL® threaded insert. Other types of inserts may include a press-fit insert or a threaded bushing. The threaded insert 404 can be manufactured from any material that is capable of withstanding the forces generated during use and firing of the rifle 100, for example, metals such as carbon steel and aluminum, polymers or graphite. The threaded insert 404 may be installed into the rear lug 308 using a locking feature, for example, a locking compound, locking pellet, or a flattened thread.

In other embodiments the takedown pin positioning mechanism 400 may not include a threaded insert 404. In these cases, the rear lug 308 may include a threaded hole to receive the screw 408. To maintain the screw 408 within the threaded hole of the rear lug 308, the takedown pin positioning mechanism 400 may also include a retention device. The retention device may be any device capable of retaining the screw 408 in an installed position, such as, a lock nut or self-locking element. The lock nut in some instances may be a jam nut having a low profile. A jam nut may lock the screw 408 in position when the jam nut is disposed onto the threads of the screw 408 and tightened against the surface of the rear lug 308. Jam nuts may be preferred in some instances, where vibrations may cause the fastened joint to loosen or separate. Similarly, self-locking elements may also prevent the screw 408 from loosening or unthreading from the rear lug 308 due to vibrations. A self-locking element may be installed onto one or more threads of the screw 408, such that, when installing the screw 408 the element engages a number of threads of the threaded hole in the rear lug 308. As a result of the engagement between the self-locking element and the threads of the threaded hole, the necessary force to unthread or loosen the screw 408 may increase. Some examples of self-locking elements may include a nylon pellet, a nylon strip, or a nylon patch. No matter whether a threaded insert 404 is installed in the rear lug 308 or not, the rear lug is to receive a screw 408.

Screw 408 may be disposed within the rear lug 308. When installed, the screw 408 may interface or engage the takedown pin 412 to position the upper receiver 108 in contact with the lower receiver 104 (as will be discussed in further detail). In this case, the screw 408 can be any type or size screw that can be installed into the threaded insert 404 and configured to engage the takedown pin 412. In many cases, the screw 408 is inserted so that none of the screw protrudes from the bottom of insert 404. This can help, for example, to minimize interference between the rear lug 308 and the lower receiver 104. In an example case, screw 408 may be a headless screw such as a dog-point set screw. A dog-point set screw may be preferred in some embodiments, because the dog-point provides a flat surface for interfacing with the takedown pin 412. In many embodiments, screw 408 provides an axial force to draw the upper receiver 108 towards the lower receiver 104 and a larger surface area in contact with the takedown pin 412 can improve this interface. In other cases, the screw 408 may be flat, plain cup, or half-dog point set screw. The screw 408 may also be a different type, for example, hex or Allen head cap screw. As shown, screw 408 is made of carbon steel and is able to withstand the applied loading and recoil forces generated during rifle firing. In a more general sense, the screw 408 can be any type of fastener that can be installed in the rear lug 308 and engage the takedown pin 412 to draw the upper receiver 108 onto the lower receiver 104.

The screw 408 may interface with takedown pin 412 to position the upper receiver 108 onto contact with the lower receiver 104. When installed the takedown pin 412 may secure the upper receiver 108 to the lower receiver 104. In this example case, the takedown pin 412 may include a cam surface that interfaces with screw 408 (as will be discussed in further detail). The takedown pin 412 may be of any length suitable for installation into the receivers 104 and 108. To this end, note that the length of the takedown pin 412 should be sufficient to allow the pin 412 to be properly supported by the aft mounting brackets 208 of the lower receiver 104 and permit proper function of the takedown pin detent mechanism (not shown). In this case, the takedown pin 412 may have a length of approximately 1.188 inches. The takedown pin 412 may be manufactured from a variety of materials, for example hardened steel, that are capable of withstanding the forces applied to the pin 412 during firing of the rifle 100.

FIGS. 6A-6D illustrate one embodiment of the takedown pin 412 including a cam surface 524, in accordance with the present disclosure. In an example case, the takedown pin 412 can be a cylinder-shaped pin having a head 504, a shank 508, a groove 512, and a cam surface 524. In other cases, the takedown pin 412 may have a conical taper, the leading end having a smaller diameter than the trailing end, as inserted into the rifle. The head 504 of the takedown pin 412 may provide a surface for rifle users to apply a force against when inserting the takedown pin 412 into the lower receiver 104 and upper receiver 108. The head 504 may also include an indicator to instruct a user how to orientate the takedown pin 412 prior to pin installation. The indicator may ensure that the user installs the takedown pin 412 such that the screw 408 can be aligned with the cam surface 524. The indicator may be any visual cue that alerts the user as to how to install the takedown pin 412 with the cam surface 524 aligned with the screw 408. In an example case, the indicator may be a set of arrows. One arrow may be located on the head 504 and the other on the lower receiver 104. When the arrows are pointing at one another, then the takedown pin 412 can be properly installed into the lower receiver 104 and rear lug 308 of the upper receiver 108. The head 504 may be any size or shape for ease of removal and installation of the takedown pin 412 from rifle 100. In this case, the head 504 can be round having a diameter of 0.437 inches. In other cases, the head 504 may be a square or hexagon and the surface may be flat or rounded. No matter the style or shape, the head 504 may be attached to the shank 508 of the takedown pin 412.

Attached to the underside of the head 504 may be a body or shank 508. When fully inserted, the shank 508 of the takedown pin 412 maintains the upper receiver 108 in contact with the lower receiver 104. The shank 508 may be any size that permits installation into the bores of the aft mounting brackets 208 of the lower receiver 104 and the rear lug 308 of the upper receiver 108. In this example case, the shank 508 may be a round cylinder having a diameter of approximately 0.275 inches. As can be seen, the shank 508 may also include a groove 512 and one or more surfaces to facilitate the installation of the takedown pin 412 (e.g., an installation surface 520, cam surface 524, and adjustment surface 528).

Figure 6A:
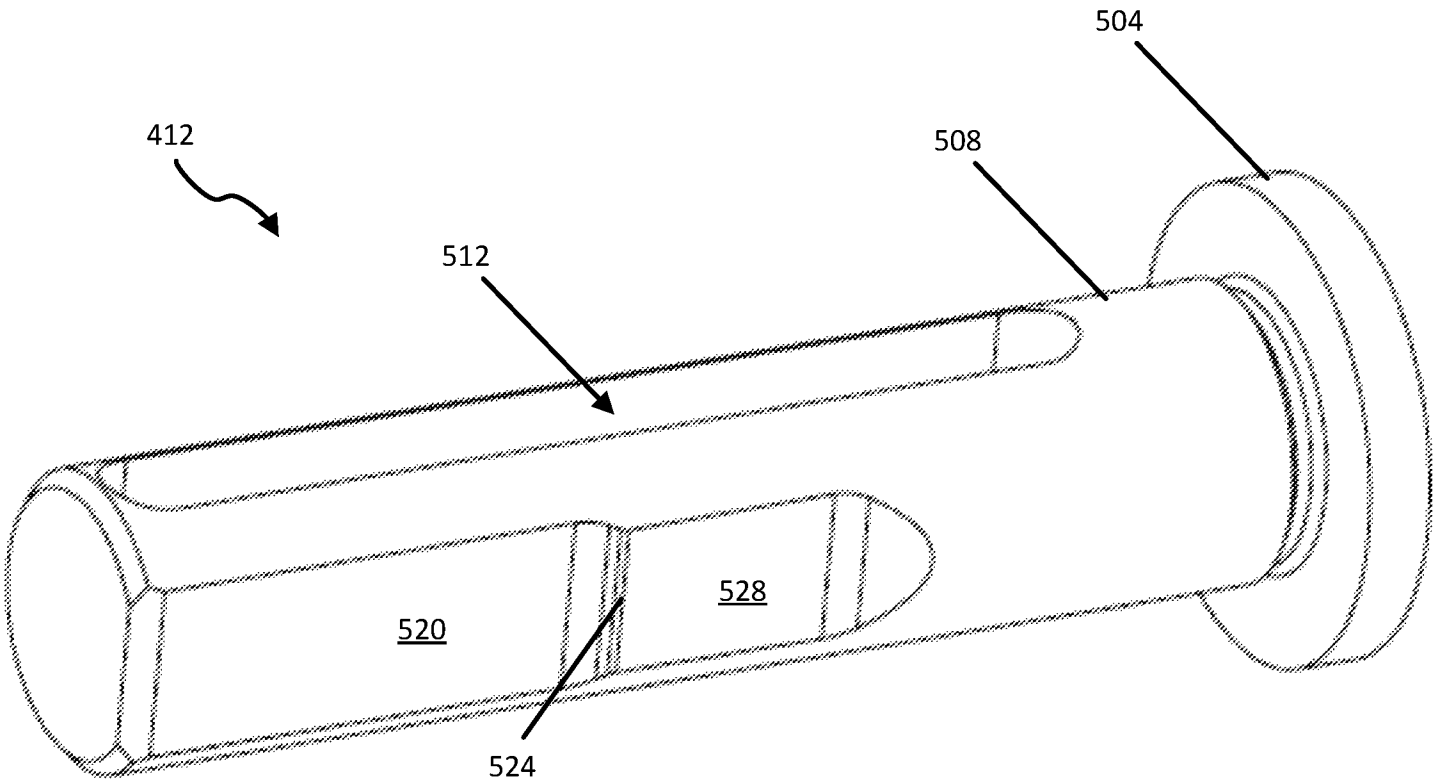
FIG. 6A is a perspective view of an example embodiment of a takedown pin including a cam surface, in accordance with an embodiment of the present disclosure.
Figure 6B:
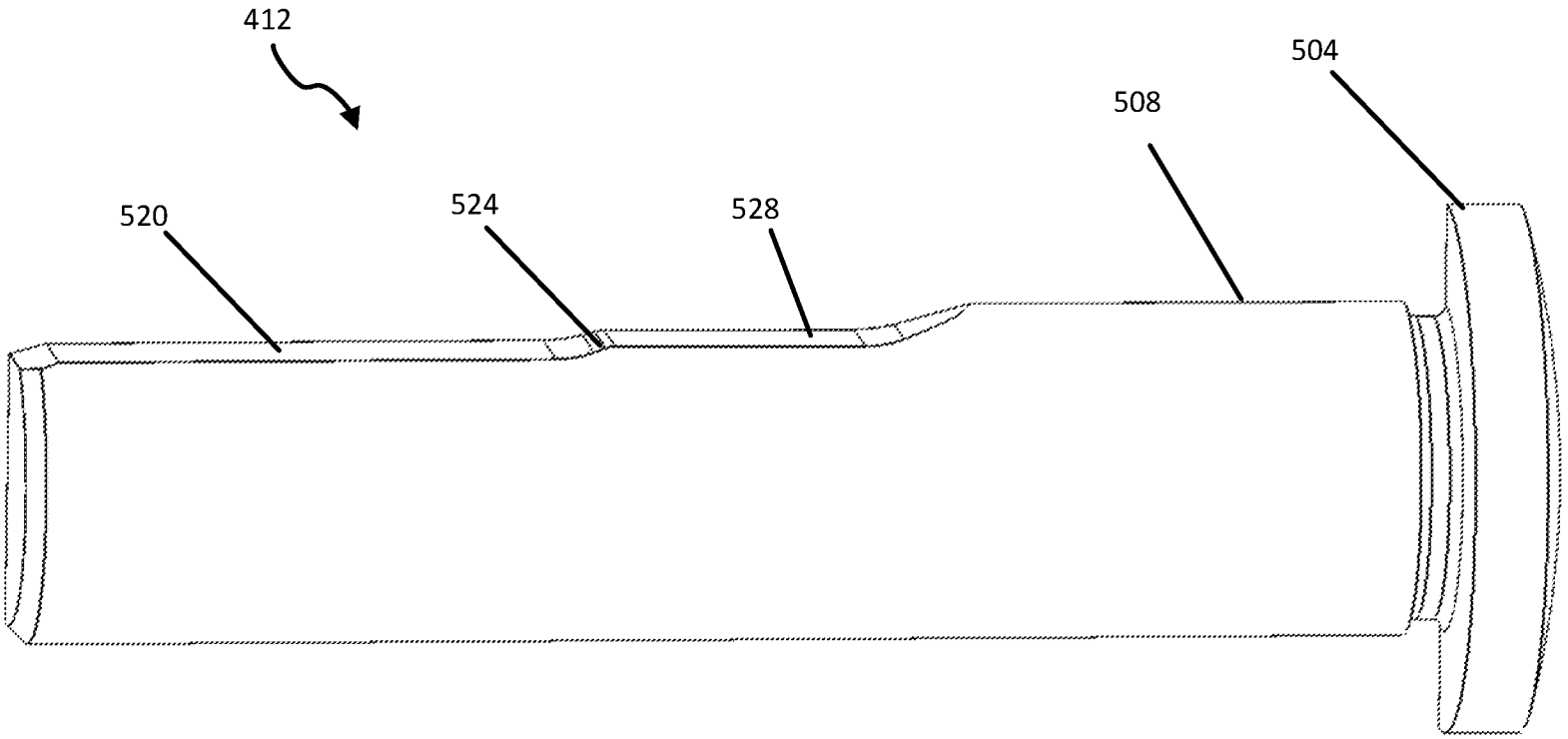
FIG. 6B is a plan view of the takedown pin shown in FIG. 6A, in accordance with an example embodiment of the present disclosure.

The shank 508 may also include groove 512 for receiving a detent plunger. The groove 512 interfaces with the detent plunger during installation and removal of the takedown pin 412. The detent plunger can help to ensure that the takedown pin 412 is properly oriented and does not fall out when the rifle is dismantled. The groove 512 may be located along the surface of the shank 508 such that the groove 512 can interface with a plunger of a detent mechanism for the rifle 100. As can be seen in FIG. 6A, in this example case the groove 512 may be located parallel to a centerline of the takedown pin 412 and positioned about 90 degrees away from the cam surface 524.

The shank 508 may include an installation surface 520. While installing the takedown pin 412, the installation surface 520 can provide clearance and less lateral resistance between the screw 408 and the pin 412, as the pin 412 travels through the bore 310 of the rear lug 308. Without this additional clearance, protruding screw 408 may prevent installation of the takedown pin 412 or increase the force necessary to install the pin 412. This surface can also help to orient the takedown pin 412, as the installation surface should be aligned with the screw 408 in order for it to be inserted into the rear lug 308. As can be seen, the installation surface 520 may be generally flat having a length and width that allows the takedown pin 412 to pass over the screw 408 with little or no lateral resistance. In this case, the installation surface 520 is approximately 0.500 inch in length having a chamfered surface at one end and a tapered surface at the other end extending into the cam surface 524.

Figure 6C:
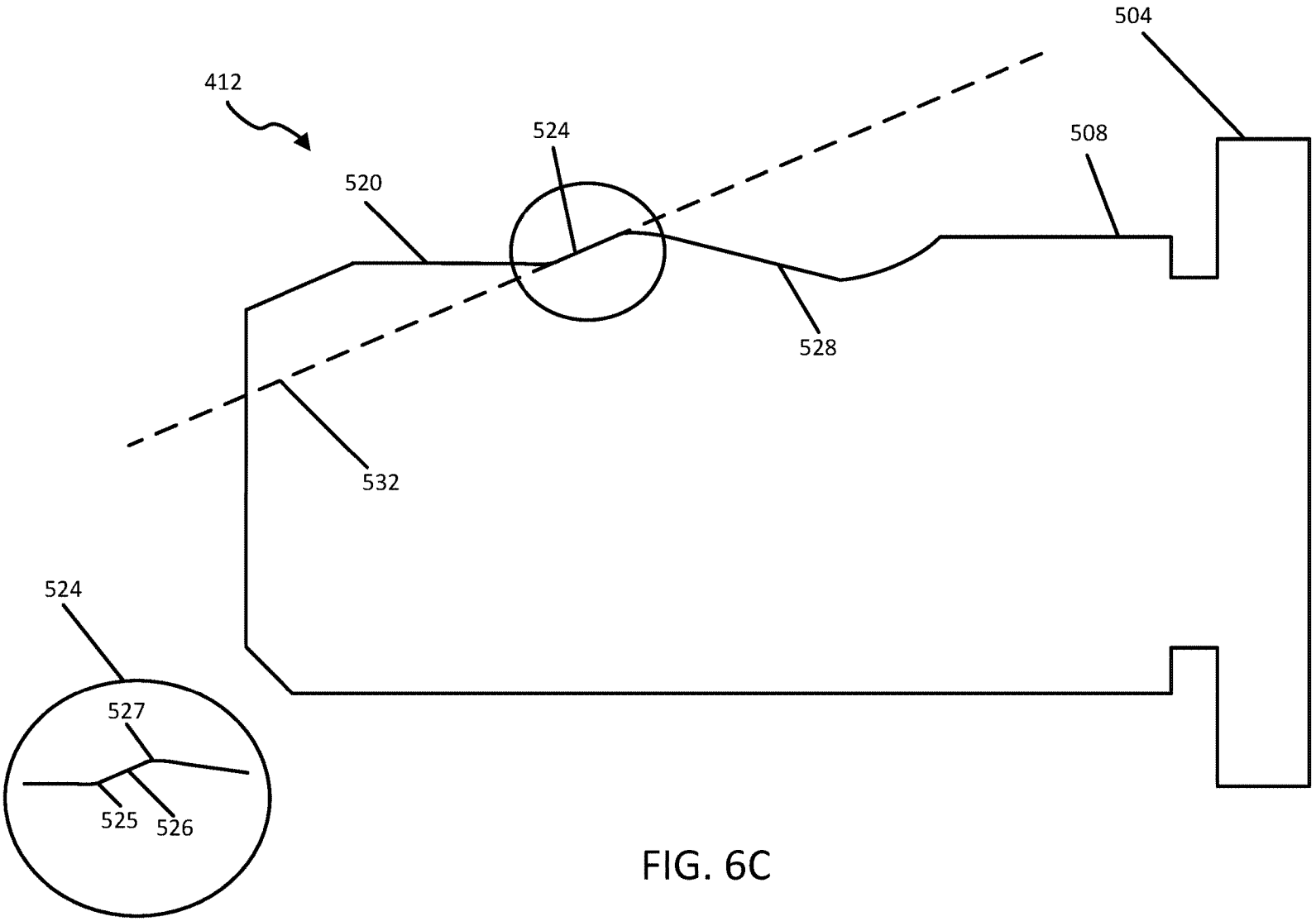
FIG. 6C is a side view of the takedown pin shown in FIG. 6A illustrating an example configuration of the cam surface, in accordance with an embodiment of the present disclosure.

The shank 508 can also include a cam surface 524 that is adjacent to the installation surface 520. In an example embodiment, the cam surface 524 is located between the installation surface 520 and the adjustment surface 528. During installation of the takedown pin 412, the cam surface 524 contacts the screw 408 to produce a camming action in which the upper receiver 108 is drawn to the lower receiver 104 to reduce a gap 120 therebetween during installation of the takedown pin 412 into firearm 100, as will be described further herein. In addition, the cam surface 524 may guide the end of the screw 408 onto the adjustment surface 528. In many embodiments, the cam surface 524 can be any size or shape capable of contacting the screw 408 and converting the lateral force applied to the takedown pin 412 into a vertical force pulling the two receivers toward each other. The cam surface 524 may also enable the takedown pin 412 to contact the end of the screw 408 and permit further installation of takedown pin 412. The cam surface 524, for example, may be a curved or planar surface that is sloped, or otherwise contoured depending on the application. In this case the cam surface 524 can comprise one, two, three or more adjoining surfaces of varying slopes. For example, the slopes of adjoining surfaces, from proximal to distal ends, may change from shallow to steep to shallow. The transition may be continuous or may be in steps. For example, the cam surface 524, in some embodiments, includes a first curved portion 525 of, for example, a 0.125 inch radius. From this radius, the cam surface 524 further includes a portion 526 that slopes upwardly along an axis 532 of the takedown pin 412 as shown in FIG. 6C. This upwardly sloped portion 526 is followed by a second curved portion 527, for example a 0.030 inch radius, to join or otherwise provide a transition to the adjustment surface 528. In more detail, as the takedown pin 412 is pushed through rear lug 308, the greatest point of resistance, and greatest resulting vertical force, may be when the highest or otherwise uppermost portion of the cam surface 524 (e.g., curved portion 527) passes the distal end 420 of screw 408. It is at this point that the two receivers are most tightly drawn together. As the takedown pin 412 advances past this point, the slight downward slope of the adjustment surface 528 along axis 536 means that the vertical force pulling the two receivers together is slightly reduced or otherwise relaxed, possibly resulting in an expansion of gap 120 between the upper and lower receivers when compared to the size of gap 120 when screw 408 was in contact with the cam surface 524. In other embodiments, the adjoining upper and lower receivers may exhibit enough elasticity that they can be compressed together at the uppermost portion of cam surface 524 and still remain in contact after a reduction in compression force as the screw 408 passes along the downwardly sloping adjustment surface 528. The final position of rest on the adjustment surface 528 can be very stable because vibrations are unlikely to back out takedown pin 412 as the horizontal force required to do so will be inadequate to move the cam surface 524 past screw 408.

Figure 6D:
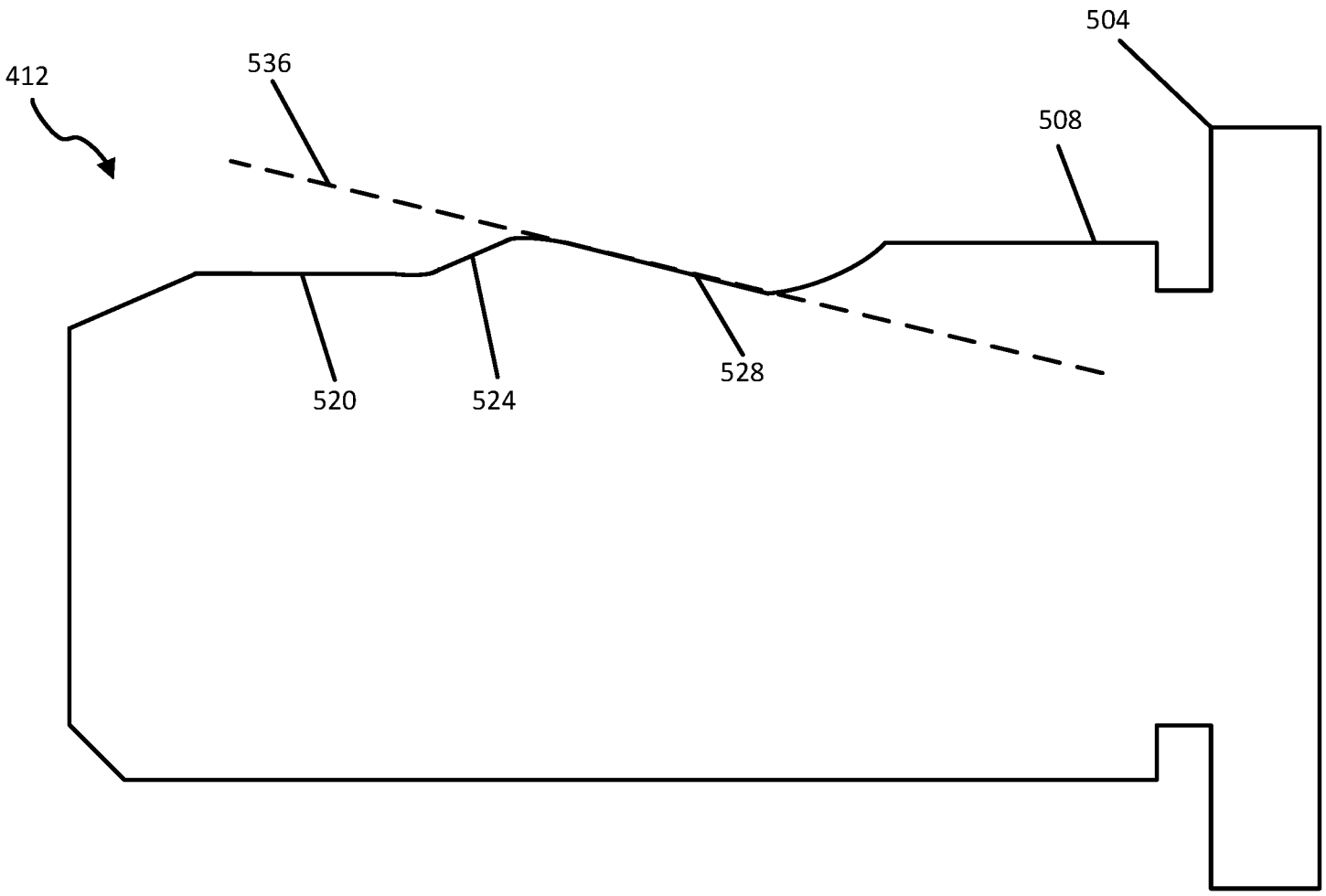
FIG. 6D is a side view of the takedown pin shown in FIG. 6A illustrating a configuration of an adjustment surface, in accordance with an embodiment of the present disclosure.

The cam surface 524 may guide the screw 408 to its final location along the adjustment surface 528 adjacent thereto. The adjustment surface 528 can provide a bearing surface to maintain the upper receiver 108 in position relative to the lower receiver 104. In addition, the adjustment surface 528, in some embodiments, can be a slight sloped surface to keep a horizontal force on takedown pin 412 that prevents the takedown pin 412 from backing out during rifle firing. In addition, surface 528 can also laterally position the upper receiver 108 and lower receiver 104 relative to one another to prevent horizontal movement of the receivers 104 and 108 relative to one another along the transverse axis 128, as described further herein. The adjustment surface 528, for example, may be flat or otherwise planar surface that is sloped, and/or contoured depending on the application. In this case, the adjustment surface 528 may be sloped, for example, at 0.25 degrees from the centerline of the takedown pin 412 in a downward direction along axis 536 as shown in FIG. 6D. In many embodiments, the adjustment surface 528 may be capable of maintaining contact with the screw 408 and re-positioning the upper receiver 108 horizontally relative to the lower receiver 104. In such embodiments, the upper receiver 108 can be biased laterally against a surface of the lower receiver 104 to prevent or otherwise reduce movement of the upper receiver 108 relative to the lower receiver 104. The upper receiver 108 can be biased in a direction along the transverse axis 128 of the firearm 100. Thus, with the two receivers in multiple points of contact with one another, the receivers may no longer move in either the vertical or horizontal directions relative to one another during rifle firing.

The surfaces of the takedown pin 412 that interface with the distal end of the screw 408 or otherwise facilitate the installation of pin 412 (e.g., an installation surface 520, cam surface 524, and adjustment surface 528) can be machined into the cylindrical body of the takedown pin 412 to produce, for instance, flat, tapered or curved surfaces. The surfaces 520, 524, and 528 may be located anywhere along the circumference of the shank 508, as long as the end of screw 408 can contact the cam surface 524 and adjustment surface 528. As can be seen, these surfaces 520, 524, and 528, in an example embodiment, are located 90 degrees from groove 512 that receives the detent plunger. Together the surfaces 520, 524 and 528 can be any suitable size or length capable of interfacing with the screw 408. The combined length of these surfaces, for example, can be of a length, such that, when the takedown pin 412 is fully installed, the adjustment surface 528 is in contact with the screw 408. In addition, the width of the surfaces 520, 524, and 528 can be any width capable of receiving part or all of the screw 408. In a more general sense, the surfaces 520, 524, and 528 can be any size or shape, such that: (1) the takedown pin 412 can be physically installed into the bore 310 of the rear lug 308 with screw 408 disposed in the bore;

and (2) when the takedown pin 412 is installed, the screw 408 may contact the cam surface 524 to re-position the upper receiver 108.

FIGS. 7A-7D illustrate installing a takedown pin 412 to reduce or eliminate the gap 120 between the upper receiver 108 and lower receiver 104, in accordance with the present disclosure. As can be seen in the cutaway view of FIG. 7A, the takedown pin 412 is in a retracted or unlocked position. In the retracted or unlocked position, the upper receiver 108 can be extended or pivoted away from the lower receiver 104 because the takedown pin 412 is not engaged in the rear lug 308 of the upper receiver 108. In some cases, the takedown pin 412 may be entirely removed from the lower receiver 104. Or, as can be seen, the takedown pin 412 can be partially installed into one of the aft mounting brackets 208. In this position the takedown pin 412 may be prevented from being completely removed from the lower receiver 104 by a detent plunger (not shown). A gap 120 may also be present between the lower receiver 104 and upper receiver 108. The gap 120 may be present when the upper receiver 108 and lower receiver 104 do not make contact with one another. As a result, during rifle firing the upper receiver 108 may move (as previously described). To address this issue, the rear lug 308 of the upper receiver 108 may include an adjustable screw 408 as shown. As can be seen, the distal end 420 of the screw 408 may protrude into the bore 310 of the rear lug 308.

Figure 7A:
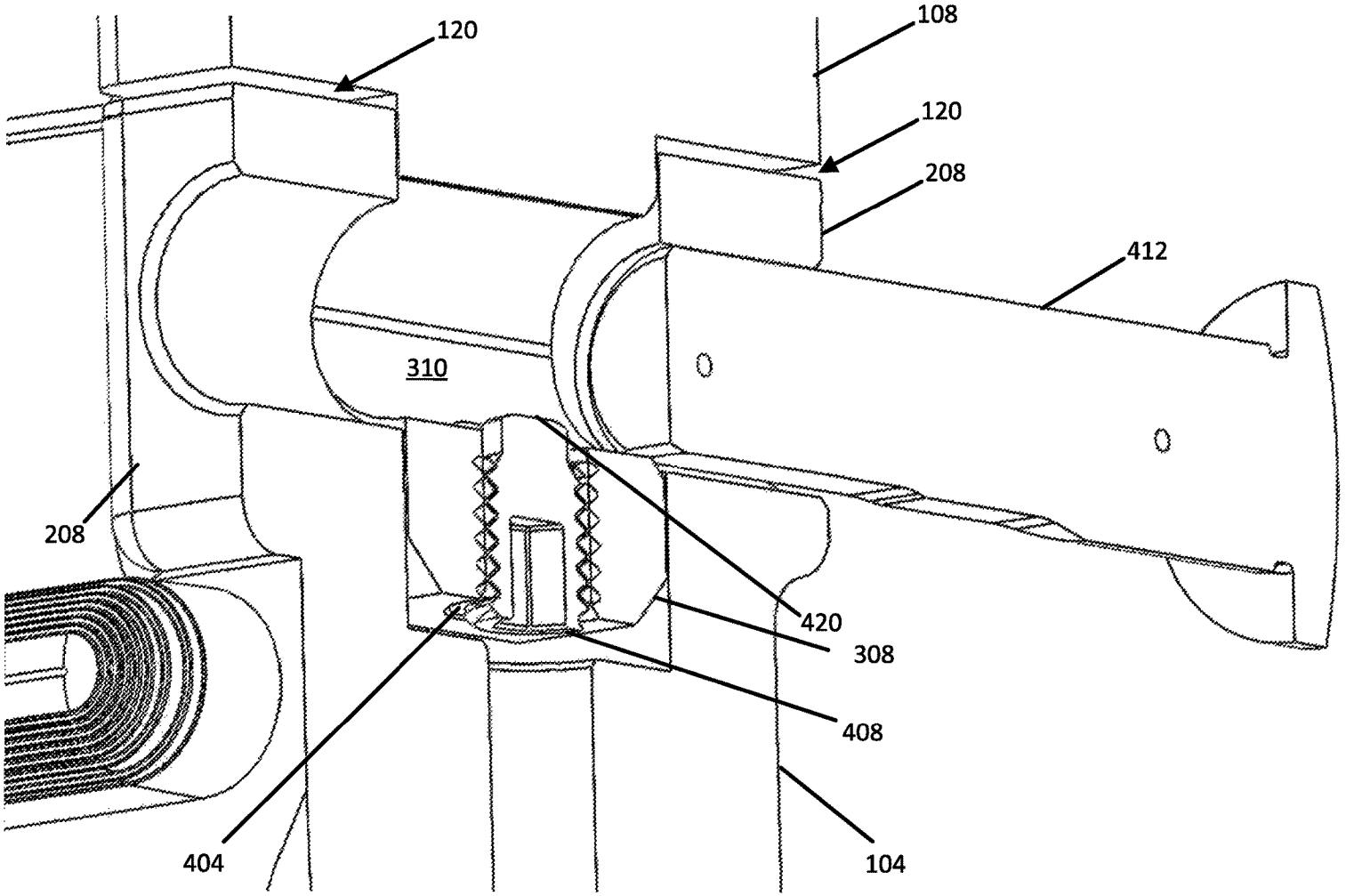
FIGS. 7A-7D are cross-sectional views of the automatic rifle illustrating the operation of the takedown pin positioning mechanism, in accordance with an embodiment of the present disclosure.
Figure 7B:
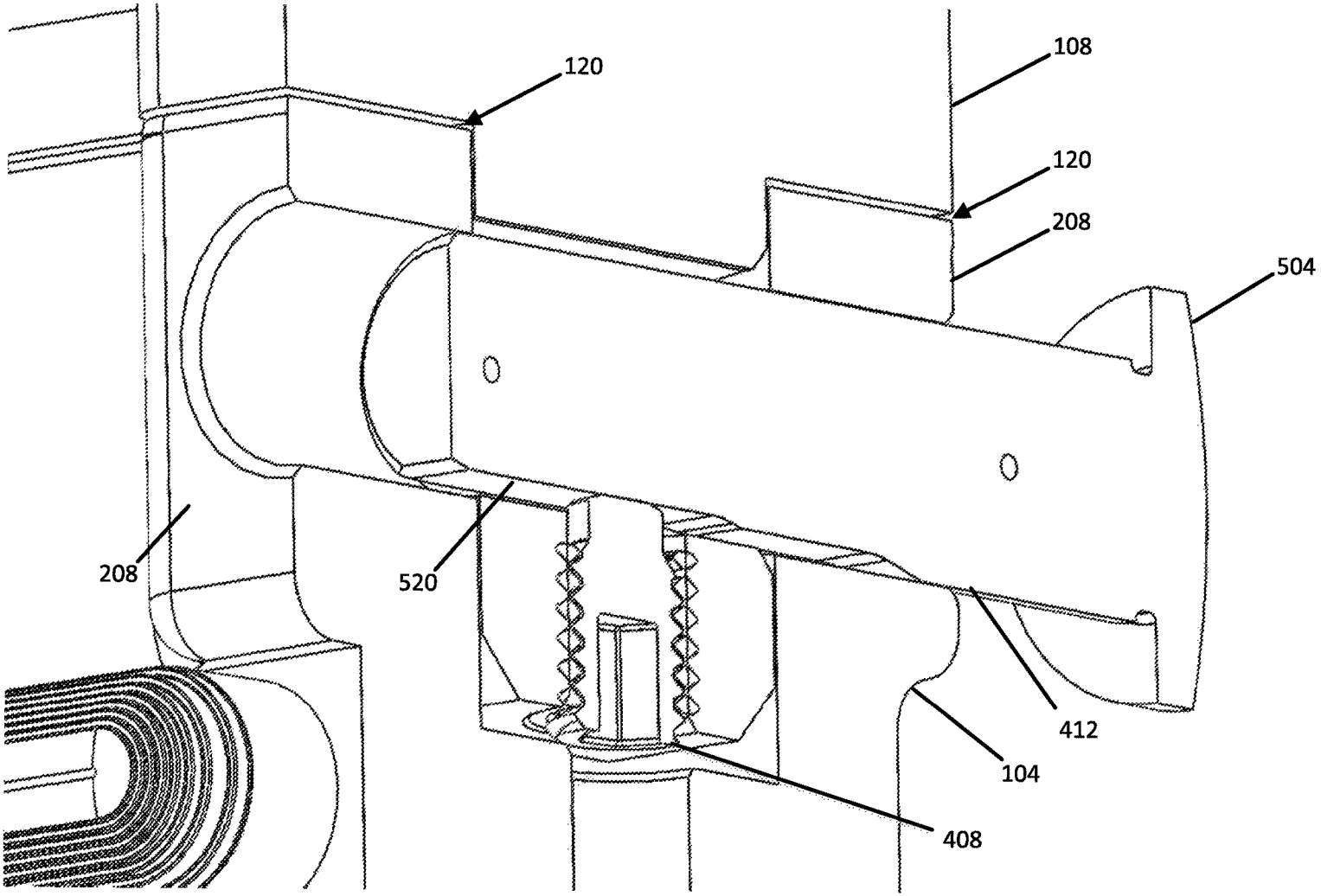

FIG. 7B illustrates the screw 408 in contact with the installation surface 520 of the takedown pin 412. As the assembler of the rifle 100 begins to install the takedown pin 412, the assembler may apply an axial force to the head 504 of the takedown pin 412. The force may be applied to the takedown pin 412 using a finger, thumb, tool, or any combination thereof. As a result of the applied force, the takedown pin 412 may move into the bore 310 of the rear lug 308 of the upper receiver 108. In this position, the takedown pin 412 is also partially inserted into the opposing aft mounting bracket 208 of the lower receiver 104 (as shown). When the takedown pin 412 begins to move into the opposing aft mounting bracket 208, the distal end 420 of screw 408 is adjacent to, but may or may not contact the installation surface 520 of the pin 412. As can be seen, the gap 120 may be reduced, but not eliminated as a result of the screw 408 contacting the installation surface 520 of the takedown pin 412 or the takedown pin 412 contacting an inner surface of the opposing aft mounting bracket 208 (or both). The gap 120 may be further reduced or eliminated when the screw 408 contacts the cam surface 524.

Figure 7C:
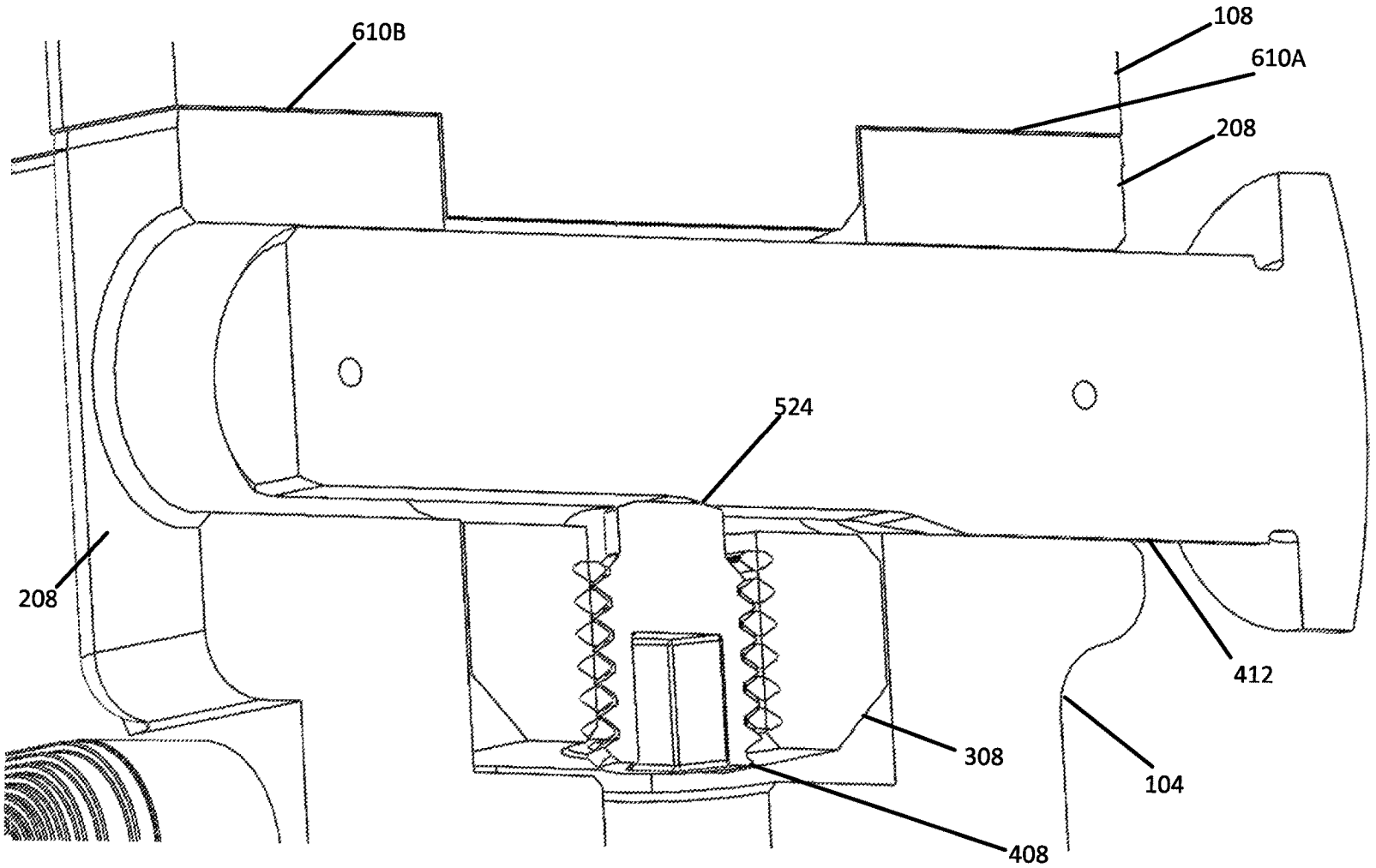

FIG. 7C is a cross-sectional view illustrating the screw 408 contacting the cam surface 524 of the takedown pin 412 and thus reducing the gap 120. As can be seen, the takedown pin 412 is positioned further into the aft mounting brackets 208 of the lower receiver 104, but is not yet completely installed. As the screw 408 contacts the cam surface 524, a downward force is applied to the screw 408 causing the upper receiver 108 to move downward vertically. In this example case, the cam surface 524 may include curved portions, such as a 0.125 and 0.030 radius (as previously described). These curved portions may be, for example, at the entry and exit of the cam surface 524. The radii may create a domed-shape surface, such that, when the distal end 420 of the screw 408 contacts the raised portion of the curved surface the maximum amount of vertical force may be applied to the upper receiver 108. In response to this contact, the screw 408 and upper receiver 108 may be drawn down towards the lower receiver 104. It is at this point that the two receivers are the most tightly drawn together. As can be seen, the upper receiver 108 may be in two points of contact, 610A and 610B, with the lower receiver 104. The screw 408 and upper receiver 108 move downward because the takedown pin 412 is constrained from moving upward by the aft mounting brackets 208. As a result of the downward movement of the upper receiver 108, the gap 120 can be reduced or eliminated. With the gap 120 reduced or eliminated, the takedown pin 412 may be completely or fully installed into the rifle 100.

Figure 7D:
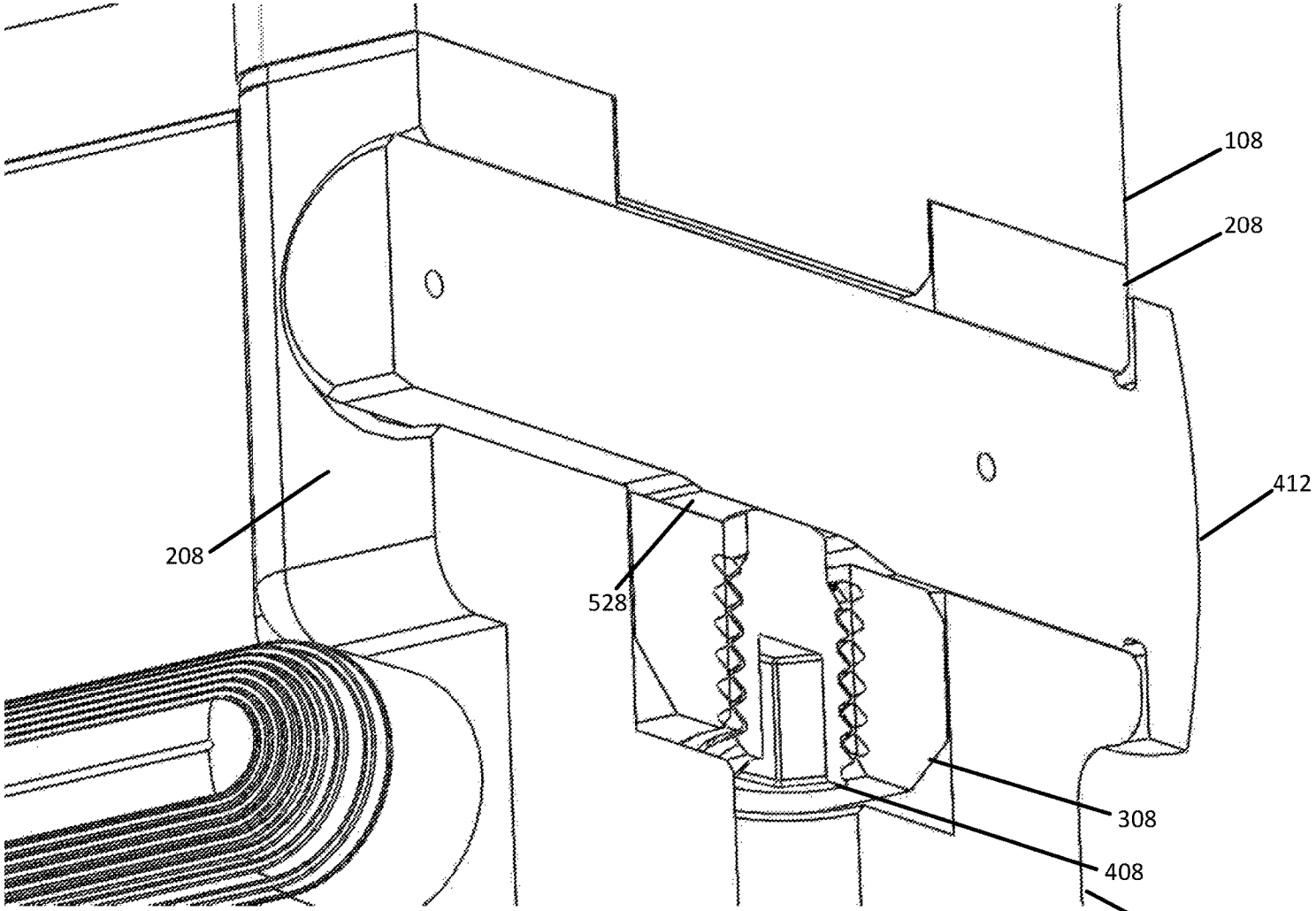

FIG. 7D illustrates the screw 408 in contact with the adjustment surface 528 of the takedown pin 412 to maintain the upper receiver 108 in a fixed position relative to lower receiver 104. As can be seen, the takedown pin 412 is completely installed into the rifle 100 and thus the takedown pin 412 is positioned within both aft mounting brackets 208 and the rear lug 308. With the takedown pin 412 in this position, the distal end 420 of the screw 408 may contact the adjustment surface 528. In some cases where the adjustment surface 528 is contoured, for example sloped, the screw 408 may also horizontally align the upper receiver 108 with respect to the lower receiver 104. In such a case, when the distal end 420 contacts the sloped adjustment surface 528 the screw 408 may re-positioned itself horizontally along that surface until the rear lug 308 contacts an interior surface of the lower receiver 104. Once the rear lug 308 contacts the lower receiver 104, the upper receiver 108 can be prevented from moving horizontally in relation to the lower receiver 104.

The previous figures illustrate an example embodiment where the screw 408 has been previously set to a desired position to eliminate the gap 120 defined by the upper receiver 108 and lower receiver 104. In some instances, however, the position of the screw 408 may need to be determined or adjusted to achieve the desired position of the upper receiver 108. One such instance, for example, may be during initial assembly of the rifle 100. As previously mentioned, rifle components can have significant tolerances that allow for ease of assembly but also create gaps between components. The amount of adjustment for reducing/eliminating the gap 120 may be dependent on the tolerances of the individual rifle components being assembled. Similarly, throughout the service life of the rifle 100 there may be other instances where the further adjustment of the upper receiver 108 may be desired.

The position of the upper receiver 108 may be adjusted by varying the distance the screw 408 extends into the bore 310 of the rear lug 308. Increasing the distance that the screw 408 protrudes into the bore 310 of the rear lug 308, for example, may increase the downward force applied to the upper receiver 108. As a result, the upper receiver 108 may move further downward, reducing the gap 120. Retracting the screw 408 from the bore of the rear lug 308 may increase the amount of play between the lower receiver 104 and the upper receiver 108 and thus increase the size of the gap 120 (if present). The position of screw 408 within the bore 310 of the rear lug 308 may be set at time of assembly of the rifle 100 or during subsequent repairs/adjustments. The screw 408 may be adjusted such that the takedown pin 412 can be removed/retracted using manual force and the gap 120 can be eliminated when the pin 412 is fully installed. Once the position of the screw 408 is set, the takedown pin 412 may be subsequently removed and re-installed any number of times without further adjustment to the position of the screw 408.

Figure 8:
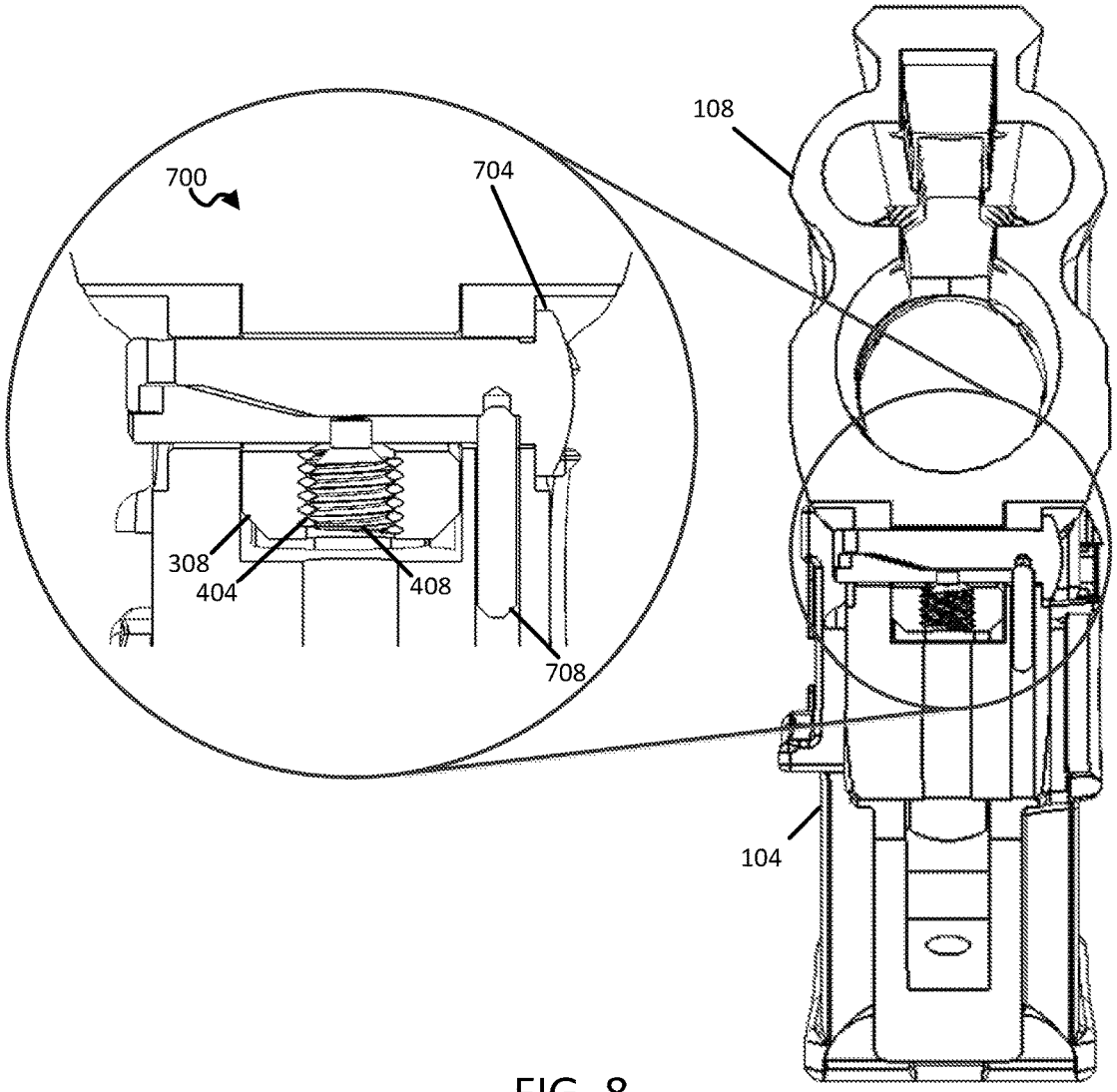
FIG. 8 is a cross-sectional view of an automatic rifle illustrating another example embodiment of a takedown pin positioning mechanism, in accordance with the present disclosure.

FIG. 8 is a cross-sectional view of the automatic rifle 100 illustrating another example embodiment of the present disclosure, including a takedown pin positioning mechanism 700. As previously described in relation to FIG. 5, the takedown pin positioning mechanism 700 may include a threaded insert 404 and screw 408 installed into the rear lug 308. Unlike the example embodiment shown in FIG. 5, in this case, the illustrated embodiment also includes a detent plunger 708. The detent plunger 708 prevents the takedown pin 704 from being inadvertently removed from the rifle 100 during firing or while performing maintenance. As depicted here, the screw 408 and detent plunger 708 may be in axes parallel to one another. As a result, both the screw 408 and detent plunger 708 engage the same surface of the takedown pin 704.

Figure 9A:
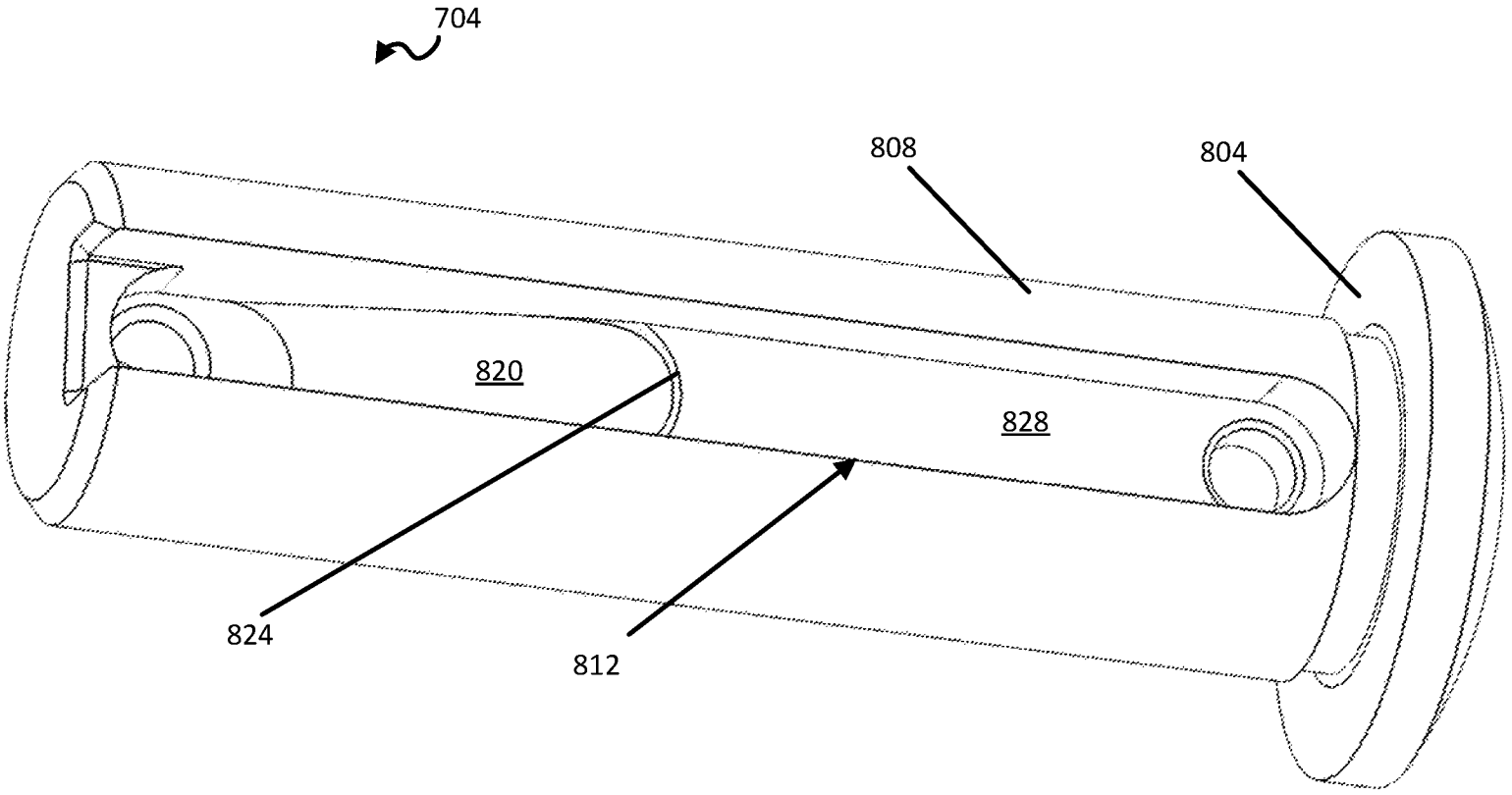
FIG. 9A is a perspective view of another embodiment of a takedown pin including a cam surface located in a longitudinal groove, in accordance with the present disclosure.
Figure 9B:
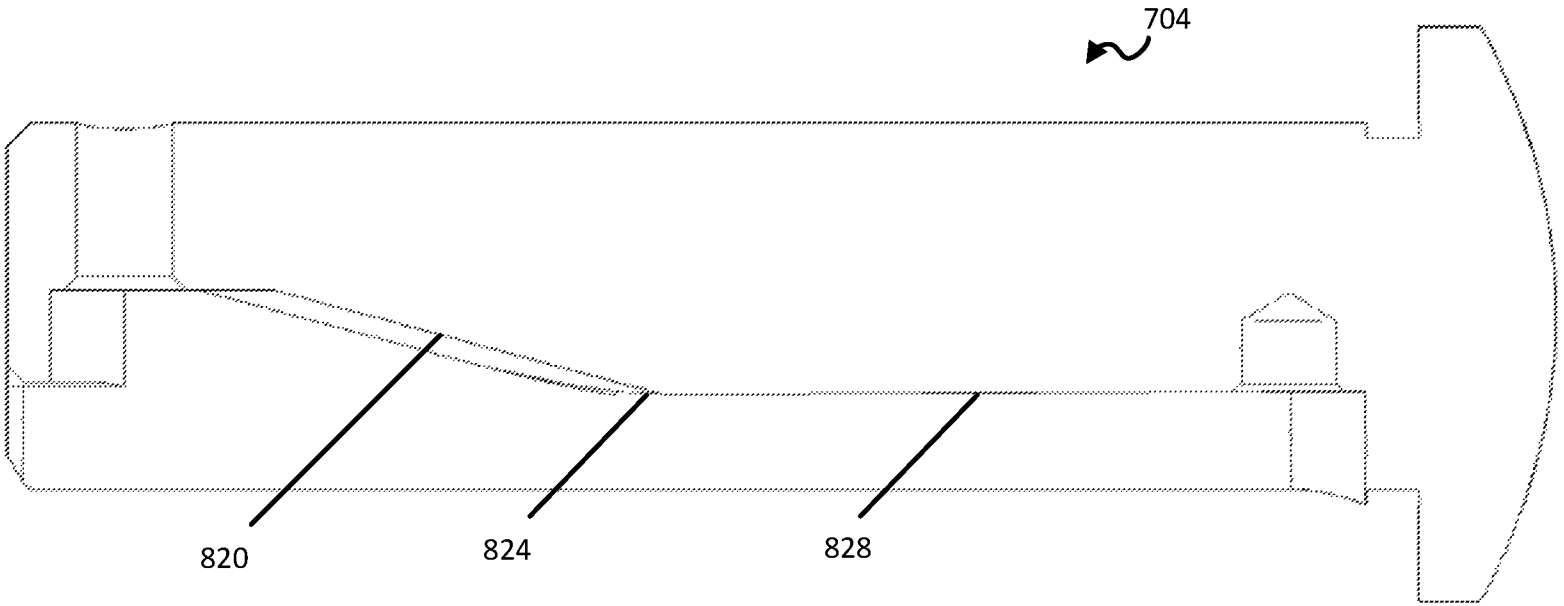
FIG. 9B is a cross-sectional view the takedown pin of FIG. 9A, in accordance with an example embodiment of the present disclosure.

FIGS. 9A and 9B illustrate the takedown pin 704 including a cam surface 824 positioned along the bottom or floor of the groove 812, in accordance with the present disclosure. The takedown pin 704 may include a head 804, a shank 808, a groove 812 and one or more surfaces to interface with the exposed end of the screw 408 (e.g., an installation surface 820, a cam surface 824, and an adjustment surface 828). The head 804 and shank 808 have been previously described in relation to FIGS. 6A and 6B. As can be seen, the takedown pin 704 includes a groove 812. The groove 812 may interface with the detent plunger 708 along the length of the takedown pin 704 during removal or installation of pin 704. As a result, the detent plunger 708 maintains contact with the takedown pin 704 while the pin 704 is re-positioned. In this example case, however, the groove 812 may also receive the screw 408. The groove 812 can be any size and/or shape to receive components of the detent plunger 708 and screw 408. The screw 408 may contact the groove 812 along the installation surface 820, cam surface 824, and adjustment surface 828. The installation surface 820, in this example case, is sloped, but in other embodiments, the surface may be flat or otherwise contoured depending on the application. The configurations and operation of the surfaces 820, 824, and 828 are similar to installation surface 520, cam surface 524, and adjustment surface 528 previously described herein in relation to FIGS. 6A-6D and 7A-D.

Pivot Pin Positioning Mechanism Structure and Operation

As previously described, the upper receiver 108 may also move in relation to the lower receiver 104 about the pivot pin 112. This movement about the pivot pin 112 may be caused by tolerances of rifle components or wear of individual components overtime. To reduce or eliminate the movement of the upper receiver 108 about the pivot pin 112, the present disclosure discloses a pivot pin positioning mechanism. This mechanism, in operation, pivotally attaches the upper receiver 108 to the lower receiver 104 and reduces or eliminates horizontal movement between the receivers.

Figure 10:
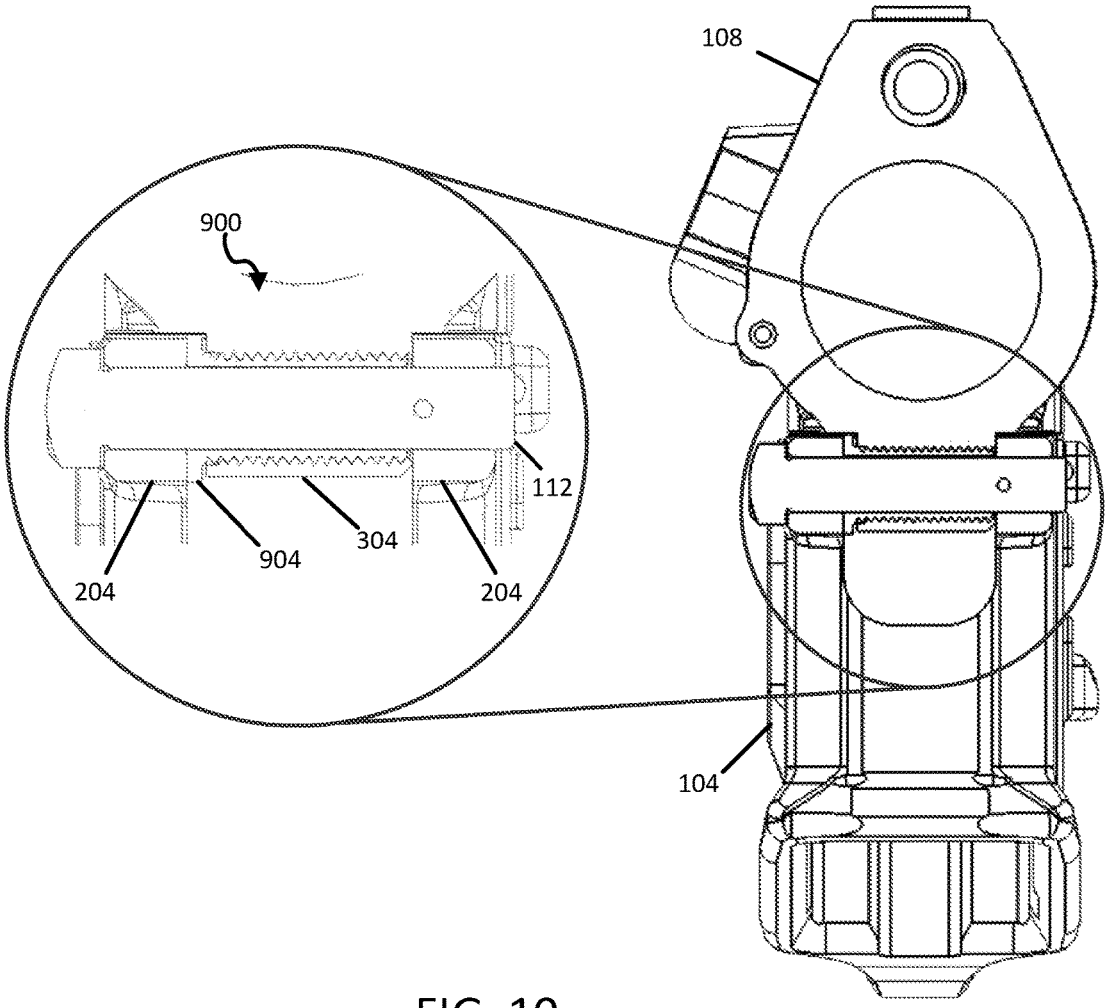
FIG. 10 is a cross-sectional view of the automatic rifle illustrating a pivot pin positioning mechanism in accordance with an embodiment of the present disclosure.

FIG. 10 is a cross-sectional view of the automatic rifle 100 illustrating a pivot pin positioning mechanism 900, in accordance with an example embodiment. As can be seen, the pivot pin 112 can be installed into the forward mounting brackets 204 of the lower receiver 104 and the forward lug 304 of the upper receiver 108. The positioning mechanism 900 may include an adjustable bushing 904 (hereinafter referred to as bushing 904). The forward lug 304 may include a threaded bore 306 for receiving bushing 904, as previously described. Without installing bushing 904, a gap may exist between the forward lug 304 and lower receiver 104. The gap may allow the upper receiver 108 to move horizontally in relation to the lower receiver 104 during rifle firing. As a result of this movement, the accuracy of the rifle 100 may be diminished. To reduce or eliminate the horizontal movement of the upper receiver 108, the bushing 904 may be installed.

The forward lug 304 of the upper receiver 108 may include a bushing 904. The bushing 904 may eliminate or bridge the gap by establishing contact with the lower receiver 104. The bushing 904 may be initially installed into the forward lug 304 and then its position can be adjusted to eliminate the gap. As previously described, there are many factors that contribute to creating the gap. To compensate for a range of potential sizes of the gap, the position of the bushing 904 within the forward lug 304 can be varied. The position of the bushing 904 can be adjusted by threading the bushing 904 into or out of the forward lug 304. The bushing position may be adjusted until the bushing 904 contacts the surface of the lower receiver 104 and thus eliminates the gap, as shown.

Figure 11:
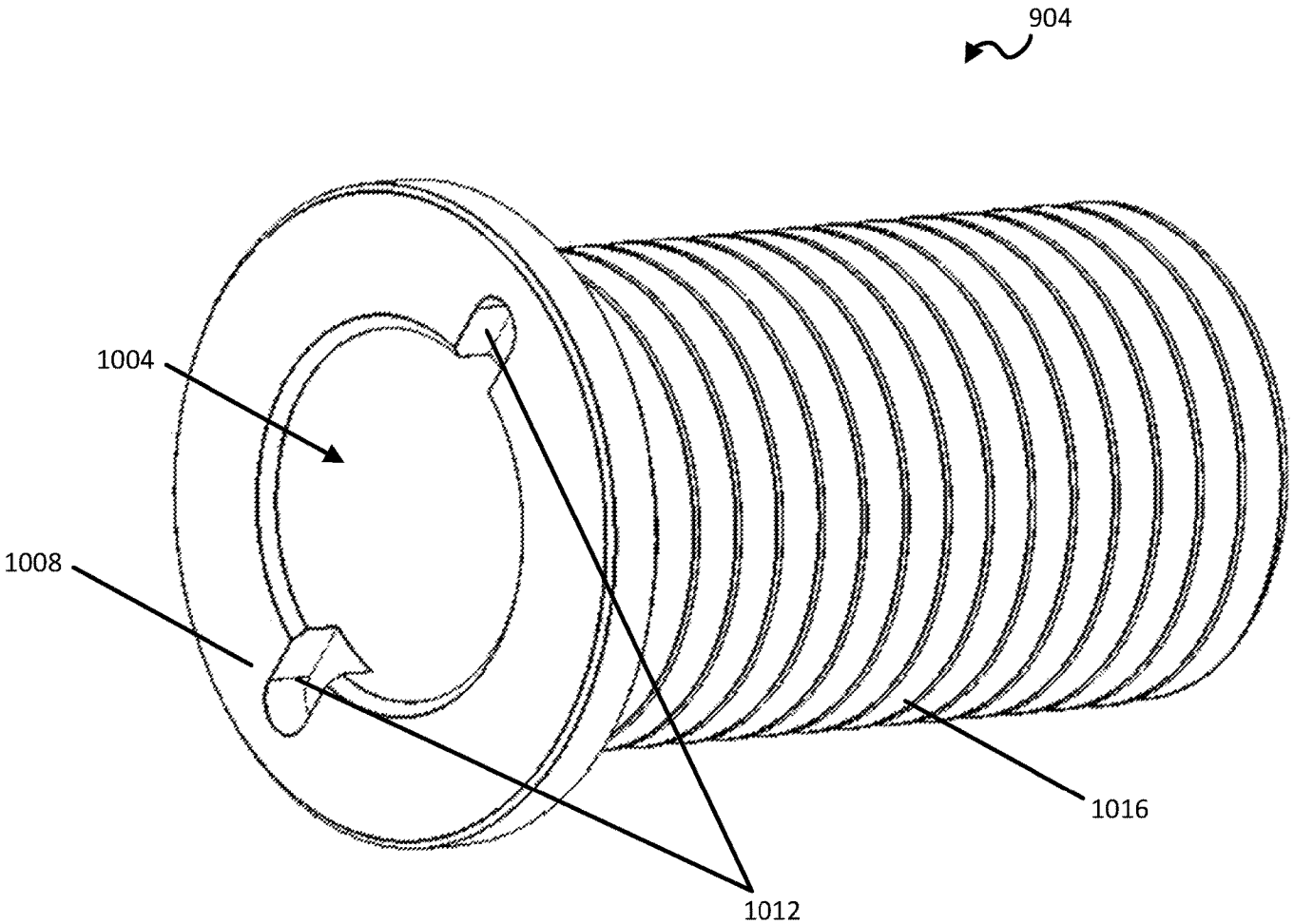
FIG. 11 is a perspective view of an adjustable bushing, in accordance with an example embodiment of the present disclosure.

FIG. 11 is a perspective view of the bushing 904, in accordance with the present disclosure. As previously described, the bushing 904 may be installed into the forward lug 304 of the upper receiver 108 to reduce/eliminate horizontal movement of the upper receiver 108 in relation to the lower receiver 104. The bushing 904 may be manufactured from any suitable material that is capable of withstanding the forces generated during rifle firing, for example, stainless steel. The length of the bushing 904 may vary depending on the application and dimensions of any interfacing components (e.g., upper receiver 108, lower receiver 104, or forward lug 304). As can be seen in FIG. 10, the bushing 904 may be of sufficient length to fill the gap while having several threads of engagement with the bore 306 of the forward lug 304. In a more general sense, however, bushing 904 may be installed into the bore 306, such that, the number of threads engaged is sufficient to withstand the applied loading. In this case, the length of bushing 904 can be approximately 0.740 inches. To ensure the thread engagement is maintained between the bushing 904 and forward lug 304, a locking device may be installed. The locking device can be any material or device that can prevent inadvertent movement of the bushing 904 (i.e., unthreading or backing out), for example, a nylon pellet or a locking compound. In this example case, the bushing 904 may be installed using a locking compound, such as, LOCTITE® threadlocker. The bushing 904 may also include a bore 1004. The bore 1004 can be of any size or shape for receiving the pivot pin 112. In this case, the bore 1004 may have a diameter of approximately 0.276 inches. The bushing 904 may further include a head 1008 and a body or shank 1016.

The bushing 904 may include a head 1008 for maintaining contact with a surface of the lower receiver 104 to transfer the applied forces from the upper receiver 108. The head 1008 can be any size and shape to install the bushing 904 and withstand the applied forces to maintain the upper receiver 108 in contact with lower receiver 104. In this case, the head 1008 may be round having approximately 0.500 inch diameter. The head 1008 may also include machined cut outs 1012 for receiving a tool. In other cases, the head 1008 may be in the shape of a hexagon or a square.

Attached to the head 1008 may be a shank 1016. The shank 1016 may transfer the applied forces from the forward lug 304 of the upper receiver to the head 1008. In this example case, the shank 1016 can be externally threaded, such that, the bushing 904 can be installed into the forward lug 304. The external threads can be any thread size or type suitable for the applied loading. In this case, the threads may be ⅜-24UNF-2A, matching the internal threads in the bore 306 of the forward lug 304. In other embodiments, however, portions of the shank 1016 may be a smooth cylindrical shape or otherwise contoured for installation of the bushing 904.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Subsequent applications claiming priority to this application may claim the disclosed subject matter in a different manner and generally may include any set of one or more limitations as variously disclosed or otherwise demonstrated herein.

Finally, the language used in the specification has been principally selected for readability and instructional purposes, and it may not have been selected to delineate or circumscribe the inventive subject matter. It is therefore intended that the scope of the disclosure be limited not by this detailed description, but rather by any claims that issue on an application based hereon. Accordingly, the embodiments described herein are intended to be illustrative, but not limiting, of the scope of the disclosure, which is set forth in the following claims.

What is claimed is:

1. A firearm comprising:

a lower receiver including a takedown pin through hole;

an upper receiver configured to receive the lower receiver and including a rear lug, the rear lug including a bore therethrough and a screw disposed in the bore; and a takedown pin with a shank and a head, the takedown pin including a cam surface along the shank, wherein the upper receiver is drawn to the lower receiver as the takedown pin is inserted in the takedown pin through hole and the bore of the rear lug due to engagement of the cam surface with the screw.

2. The firearm of claim 1, further comprising a threaded insert installed in a wall of the rear lug, wherein the screw is inserted into the threaded insert and a distal end of the screw extends into the bore of the rear lug.

3. The firearm of claim 1, wherein the screw is installed perpendicular to a longitudinal axis of the firearm.

4. The firearm of claim 3, wherein the screw is installed perpendicular to a transverse axis of the firearm.

5. The firearm of claim 3, wherein the screw is installed through a bottom surface of the rear lug.

6. The firearm of claim 3 wherein a position of the screw in the bore can be adjusted to extend or contract an effective diameter of the bore.

7. The firearm of claim 1, wherein the cam surface includes a first surface sloping away from a centerline of the takedown pin when moving toward the head from a distal end of the shank.

8. The firearm of claim 7, wherein the takedown pin includes a second surface adjacent the first surface, the second surface sloping toward the centerline when moving toward the head from the distal end of the shank.

9. The firearm of claim 1, wherein the upper receiver and the lower receiver define a gap therebetween when the takedown pin is fully inserted, wherein a size of the gap is reduced or increased by adjusting a position of a distal end of the screw within the bore of the rear lug.

10. The firearm of claim 1, wherein the shank includes a first substantially planar surface, a second surface, and a third surface, wherein:

the first substantially planar surface is located a distance from a centerline of the takedown pin, the distance being less than a largest radius of a body of the takedown pin;

the second surface slopes away from the centerline as it extends from the first substantially planar surface towards the head of the takedown pin; and the third surface having a first end and a second end, the first end transitioning from the second surface and the second end toward the head of the takedown pin, wherein at least a portion of the third surface is sloped toward the centerline as it extends from the first end to the second end.

11. The firearm of claim 1, wherein when the takedown pin is installed, the cam surface faces downward towards the lower receiver.

12. The firearm of claim 1, wherein the cam surface is positioned about 90 degrees around the shank of the takedown pin from a longitudinal groove in the shank of the takedown pin, the longitudinal groove constructed and arranged for receiving a detent plunger.

13. The firearm of claim 12 wherein the longitudinal groove includes a depression in each end of the longitudinal groove, each depression positioned and sized to receive the detent plunger in an extended position.

14. The firearm of claim 1, wherein the cam surface is formed in a floor of a longitudinal groove defined in the shank of the takedown pin, the longitudinal groove configured for receiving a detent plunger.

15. The firearm of claim 14 wherein the longitudinal groove includes a depression in each end of the longitudinal groove, the depression positioned and sized to receive the detent plunger in an extended position.

16. The firearm of claim 1, wherein the upper receiver further comprises:

a forward lug disposed on the upper receiver, wherein the forward lug includes a bore and an adjustable bushing disposed in the bore; and a pivot pin installed in the lower receiver and the adjustable bushing, wherein the upper receiver is pivotally attached to the lower receiver.

17. The firearm of claim 1, wherein the rear lug further includes a threaded hole located within a bottom surface of the rear lug and perpendicular to the bore of the rear lug.

18. The firearm of claim 1, further comprising a self-locking element disposed on one or more threads of the screw, wherein the self-locking element is to engage one or more threads of a threaded hole of the rear lug to secure the screw in the threaded hole of the rear lug.

* * * * *